US012173940B2

(12) United States Patent
Lingrey et al.

(10) Patent No.: US 12,173,940 B2
(45) Date of Patent: Dec. 24, 2024

(54) AIR CONDITIONING SYSTEM WITH CAPACITY CONTROL AND CONTROLLED HOT WATER GENERATION

(71) Applicant: Climate Master, Inc., Oklahoma City, OK (US)

(72) Inventors: David J. Lingrey, Yukon, OK (US); Michael S. Privett, Tuttle, OK (US); Reem S. Merchant, Oklahoma City, OK (US); Michael F. Taras, Oklahoma City, OK (US)

(73) Assignee: Climate Master, Inc., Oklahoma City, OK (US)

( * ) Notice: Subject to any disclaimer, the term of this patent is extended or adjusted under 35 U.S.C. 154(b) by 0 days.

(21) Appl. No.: 18/057,076

(22) Filed: Nov. 18, 2022

(65) Prior Publication Data

US 2023/0092215 A1 Mar. 23, 2023

Related U.S. Application Data

(62) Division of application No. 16/897,252, filed on Jun. 9, 2020, now Pat. No. 11,506,430.
(Continued)

(51) Int. Cl.
*F25B 41/26* (2021.01)
*F25B 13/00* (2006.01)

(52) U.S. Cl.
CPC ..... *F25B 41/26* (2021.01); *F25B 13/00* (2013.01)

(58) Field of Classification Search
CPC ..... F25B 13/00; F25B 41/26
See application file for complete search history.

(56) References Cited

U.S. PATENT DOCUMENTS 1,723,649 A 8/1929 Earl
3,354,774 A 11/1967 Smitzer et al.
(Continued)

FOREIGN PATENT DOCUMENTS

AU 2013200092 B2 4/2013
CA 1178268 11/1984
(Continued)

OTHER PUBLICATIONS

"134-XS and 134-S Series Compressors ECOnomizer (EA-12-03-E)," 134-XS and 134-S series—Application and Maintenance Manual, Technical report EA1203E, RefComp Refrigerant Compressors, undated but believed to be publicly available at least as early as Mar. 2014 (4 pages).
(Continued)

*Primary Examiner* — Henry T Crenshaw
(74) *Attorney, Agent, or Firm* — Crowell & Moring LLP; Thomas E. Williams

(57) ABSTRACT

An HVAC system is disclosed, comprising: (a) a compressor, (b) a source heat exchanger for exchanging heat with a source fluid, (c) a first load heat exchanger operable for heating/cooling air in a space, (d) a second load heat exchanger for heating water, (e) first and second reversing valves, (f) first and second 3-way valves, (f) a bi-directional electronic expansion valve, (g) a first bi-directional valve, and (h) a second bi-directional valve to modulate exchange of heat in the first load heat exchanger when operating as an evaporator and to control flashing of the refrigerant entering the source heat exchanger when operating as an evaporator, (h) a source pump for circulating the source fluid through the first load heat exchanger, (i) a water pump for circulating water through the second load heat exchanger, and (j) a controller to control operation of the foregoing.

15 Claims, 19 Drawing Sheets

Related U.S. Application Data

(60) Provisional application No. 62/874,310, filed on Jul. 15, 2019.

(56) References Cited

U.S. PATENT DOCUMENTS

| | | | |
|---|---|---|---|
| 3,460,353 | A | 8/1969 | Ogata et al. |
| 3,916,638 | A | 11/1975 | Schmidt |
| 3,938,352 | A | 2/1976 | Schmidt |
| 4,072,187 | A | 2/1978 | Lodge |
| 4,091,636 | A | 5/1978 | Margen |
| 4,173,865 | A | 11/1979 | Sawyer |
| 4,179,894 | A | 12/1979 | Hughes |
| 4,257,239 | A | 3/1981 | Partin et al. |
| 4,299,098 | A | 11/1981 | Derosier |
| 4,399,664 | A | 8/1983 | Derosier |
| 4,441,901 | A | 4/1984 | Endoh |
| 4,476,920 | A | 10/1984 | Drucker et al. |
| 4,493,193 | A | 1/1985 | Fisher |
| 4,528,822 | A | 7/1985 | Glamm |
| 4,538,418 | A | 9/1985 | Lawrence et al. |
| 4,575,001 | A | 3/1986 | Oskarsson et al. |
| 4,584,844 | A | 4/1986 | Lemal |
| 4,592,206 | A | 6/1986 | Yamazaki et al. |
| 4,598,557 | A | 7/1986 | Robinson et al. |
| 4,645,908 | A | 2/1987 | Jones |
| 4,646,537 | A | 3/1987 | Crawford |
| 4,646,538 | A | 3/1987 | Blackshaw et al. |
| 4,685,307 | A | 8/1987 | Jones |
| 4,693,089 | A | 9/1987 | Bourne et al. |
| 4,698,978 | A | 10/1987 | Jones |
| 4,727,727 | A | 3/1988 | Reedy |
| 4,766,734 | A | 8/1988 | Dudley |
| 4,776,180 | A | 10/1988 | Patton et al. |
| 4,796,437 | A | 1/1989 | James |
| 4,798,059 | A | 1/1989 | Morita |
| 4,798,240 | A | 1/1989 | Gerstmann et al. |
| 4,799,363 | A | 1/1989 | Nakamura |
| 4,835,976 | A | 6/1989 | Torrence |
| 4,856,578 | A | 8/1989 | Mccahill |
| 4,893,476 | A | 1/1990 | Bos et al. |
| 4,909,041 | A | 3/1990 | Jones |
| 4,909,312 | A | 3/1990 | Biedenbach et al. |
| 4,920,757 | A | 5/1990 | Gazes et al. |
| 4,924,681 | A | 5/1990 | De Vit et al. |
| 4,938,032 | A | 7/1990 | Mudford |
| 5,038,580 | A | 8/1991 | Hart |
| 5,044,425 | A | 9/1991 | Tatsumi et al. |
| 5,081,848 | A | 1/1992 | Rawlings et al. |
| 5,088,296 | A | 2/1992 | Hamaoka |
| 5,099,651 | A | 3/1992 | Fischer |
| 5,105,629 | A | 4/1992 | Parris et al. |
| 5,136,855 | A | 8/1992 | Lenarduzzi |
| 5,172,564 | A | 12/1992 | Reedy |
| 5,187,944 | A | 2/1993 | Jarosch |
| 5,224,357 | A | 7/1993 | Galiyano et al. |
| 5,239,838 | A | 8/1993 | Tressler |
| 5,269,153 | A | 12/1993 | Cawley |
| 5,305,822 | A | 4/1994 | Kogetsu et al. |
| 5,309,732 | A | 5/1994 | Sami |
| 5,323,844 | A | 6/1994 | Sumitani et al. |
| 5,339,890 | A | 8/1994 | Rawlings |
| 5,355,688 | A | 10/1994 | Rafalovich et al. |
| 5,372,016 | A | 12/1994 | Rawlings |
| 5,438,846 | A | 8/1995 | Datta |
| 5,461,876 | A | 10/1995 | Dressler |
| 5,463,619 | A | 10/1995 | Van et al. |
| 5,465,588 | A | 11/1995 | Mccahill et al. |
| 5,477,914 | A | 12/1995 | Rawlings |
| 5,497,629 | A | 3/1996 | Rafalovich et al. |
| 5,507,337 | A | 4/1996 | Rafalovich et al. |
| 5,533,355 | A | 7/1996 | Rawlings |
| 5,564,282 | A | 10/1996 | Kaye |
| 5,613,372 | A | 3/1997 | Beal et al. |
| 5,619,864 | A | 4/1997 | Reedy |
| 5,622,057 | A | 4/1997 | Bussjager et al. |
| 5,628,200 | A | 5/1997 | Pendergrass |
| 5,651,265 | A | 7/1997 | Grenier |
| 5,669,224 | A | 9/1997 | Lenarduzzi |
| 5,689,966 | A | 11/1997 | Zess et al. |
| 5,706,888 | A | 1/1998 | Ambs et al. |
| 5,729,985 | A | 3/1998 | Yoshihara et al. |
| 5,758,514 | A | 6/1998 | Genung et al. |
| 5,802,864 | A | 9/1998 | Yarbrough et al. |
| 5,927,088 | A | 7/1999 | Shaw |
| 5,937,665 | A | 8/1999 | Kiessel et al. |
| 5,953,926 | A | 9/1999 | Dressler et al. |
| 5,983,660 | A | 11/1999 | Kiessel et al. |
| 6,000,154 | A | 12/1999 | Berard et al. |
| 6,016,629 | A | 1/2000 | Sylvester et al. |
| 6,032,472 | A | 3/2000 | Heinrichs et al. |
| 6,070,423 | A | 6/2000 | Hebert |
| 6,082,125 | A | 7/2000 | Savtchenko |
| 6,123,147 | A | 9/2000 | Pittman |
| 6,149,066 | A | 11/2000 | Perry et al. |
| 6,167,715 | B1 | 1/2001 | Hebert |
| 6,212,892 | B1 | 4/2001 | Rafalovich |
| 6,227,003 | B1 | 5/2001 | Smoiinsky |
| 6,253,564 | B1 | 7/2001 | Yarbrough et al. |
| 6,347,527 | B1 | 2/2002 | Bailey et al. |
| 6,385,983 | B1 | 5/2002 | Sakki et al. |
| 6,418,745 | B1 | 7/2002 | Ratliff |
| 6,434,960 | B1 | 8/2002 | Rousseau |
| 6,474,087 | B1 | 11/2002 | Lifson |
| 6,536,221 | B2 | 3/2003 | James |
| 6,615,602 | B2 | 9/2003 | Wilkinson |
| 6,644,047 | B2 | 11/2003 | Taira et al. |
| 6,655,164 | B2 | 12/2003 | Rogstam |
| 6,662,864 | B2 | 12/2003 | Burk et al. |
| 6,668,572 | B1 | 12/2003 | Seo et al. |
| 6,694,750 | B1 | 2/2004 | Lifson et al. |
| 6,729,151 | B1 | 5/2004 | Thompson |
| 6,751,972 | B1 | 6/2004 | Jungwirth |
| 6,804,975 | B2 | 10/2004 | Park |
| 6,817,205 | B1 | 11/2004 | Lifson et al. |
| 6,826,921 | B1 | 12/2004 | Uselton |
| 6,857,285 | B2 | 2/2005 | Hebert |
| 6,892,553 | B1 | 5/2005 | Lifson et al. |
| 6,915,656 | B2 | 7/2005 | Ratliff |
| 6,931,879 | B1 | 8/2005 | Wiggs |
| 6,938,438 | B2 | 9/2005 | Lifson et al. |
| 6,941,770 | B1 | 9/2005 | Taras et al. |
| 7,000,423 | B2 | 2/2006 | Lifson et al. |
| 7,028,492 | B2 | 4/2006 | Taras et al. |
| 7,059,151 | B2 | 6/2006 | Taras et al. |
| 7,114,349 | B2 | 10/2006 | Lifson et al. |
| 7,150,160 | B2 | 12/2006 | Herbert |
| 7,155,922 | B2 | 1/2007 | Harmon et al. |
| 7,185,505 | B2 | 3/2007 | Kamimura |
| RE39,597 | E | 5/2007 | Rousseau |
| 7,210,303 | B2 | 5/2007 | Zhang et al. |
| 7,228,696 | B2 | 6/2007 | Ambs et al. |
| 7,228,707 | B2 | 6/2007 | Lifson et al. |
| 7,234,311 | B2 | 6/2007 | Lifson et al. |
| 7,254,955 | B2 | 8/2007 | Otake et al. |
| 7,263,848 | B2 | 9/2007 | Bhatti |
| 7,272,948 | B2 | 9/2007 | Taras et al. |
| 7,275,384 | B2 | 10/2007 | Taras et al. |
| 7,275,385 | B2 | 10/2007 | Abel et al. |
| 7,290,399 | B2 | 11/2007 | Taras et al. |
| 7,325,414 | B2 | 2/2008 | Taras et al. |
| 7,454,919 | B2 | 11/2008 | Ookoshi et al. |
| 7,484,374 | B2 | 2/2009 | Pham et al. |
| 7,617,697 | B2 | 11/2009 | McCaughan |
| 7,654,104 | B2 | 2/2010 | Groll et al. |
| 7,716,943 | B2 | 5/2010 | Seefeldt |
| 7,752,855 | B2 | 7/2010 | Matsuoka et al. |
| 7,770,405 | B1 | 8/2010 | Dillon |
| 7,823,404 | B2 | 11/2010 | Hanson |
| 7,845,190 | B2 | 12/2010 | Pearson |
| 7,854,137 | B2 | 12/2010 | Lifson et al. |
| 7,856,834 | B2 | 12/2010 | Haley |
| 7,878,010 | B2 | 2/2011 | Nishimura et al. |
| 7,913,501 | B2 | 3/2011 | Ellis et al. |
| 7,937,960 | B2 | 5/2011 | Matsui |

(56) References Cited

U.S. PATENT DOCUMENTS

| | | | |
|---|---|---|---|
| 7,946,121 | B2 | 5/2011 | Yamaguchi et al. |
| 7,954,333 | B2 | 6/2011 | Yoshimi |
| 7,958,737 | B2 | 6/2011 | Lifson et al. |
| 7,975,495 | B2 | 7/2011 | Voorhis et al. |
| 7,975,506 | B2 | 7/2011 | James et al. |
| 7,980,086 | B2 | 7/2011 | Kotani et al. |
| 7,980,087 | B2 | 7/2011 | Anderson et al. |
| 7,997,092 | B2 | 8/2011 | Lifson et al. |
| 7,997,093 | B2 | 8/2011 | Kasahara |
| 8,033,123 | B2 | 10/2011 | Kasahara et al. |
| 8,037,713 | B2 | 10/2011 | Haley et al. |
| 8,069,682 | B2 | 12/2011 | Yoshimi et al. |
| 8,074,459 | B2 | 12/2011 | Murakami et al. |
| 8,079,228 | B2 | 12/2011 | Lifson et al. |
| 8,079,229 | B2 | 12/2011 | Lifson et al. |
| 8,082,751 | B2 | 12/2011 | Wiggs |
| 8,136,364 | B2 | 3/2012 | Lifson et al. |
| 8,156,757 | B2 | 4/2012 | Doty et al. |
| 8,191,376 | B2 | 6/2012 | Fox et al. |
| 8,215,121 | B2 | 7/2012 | Yoshimi et al. |
| 8,220,531 | B2 | 7/2012 | Murakami et al. |
| 8,286,438 | B2 | 10/2012 | McCahill |
| 8,381,538 | B2 | 2/2013 | Lifson et al. |
| 8,397,522 | B2 | 3/2013 | Springer et al. |
| 8,402,779 | B2 | 3/2013 | Nishimura et al. |
| 8,418,482 | B2 | 4/2013 | Bush et al. |
| 8,418,486 | B2 | 4/2013 | Taras et al. |
| 8,424,326 | B2 | 4/2013 | Mitra et al. |
| 8,459,052 | B2 | 6/2013 | Bush et al. |
| 8,528,359 | B2 | 9/2013 | Lifson et al. |
| 8,555,703 | B2 | 10/2013 | Yonemori et al. |
| 8,561,425 | B2 | 10/2013 | Mitra et al. |
| 8,650,893 | B2 | 2/2014 | Hanson |
| 8,695,404 | B2 | 4/2014 | Kadle et al. |
| 8,701,432 | B1 | 4/2014 | Olson |
| 8,726,682 | B1 | 5/2014 | Olson |
| 8,733,429 | B2 | 5/2014 | Harrison et al. |
| 8,756,943 | B2 | 6/2014 | Chen et al. |
| 8,769,982 | B2 | 7/2014 | Ignatiev et al. |
| 8,910,419 | B1 | 12/2014 | Oberst |
| 8,919,139 | B2 | 12/2014 | Yamada et al. |
| 8,959,950 | B2 | 2/2015 | Doty et al. |
| 8,984,903 | B2 | 3/2015 | Itoh et al. |
| 9,052,125 | B1 | 6/2015 | Dostal |
| 9,297,565 | B2 | 3/2016 | Hung |
| 9,303,908 | B2 | 4/2016 | Kasahara |
| 9,383,026 | B2 | 7/2016 | Eggleston |
| 9,459,032 | B2 | 10/2016 | Nishimura et al. |
| 9,551,514 | B2 | 1/2017 | Tartakovsky |
| 9,562,700 | B2 | 2/2017 | Watanabe |
| 9,599,377 | B2 | 3/2017 | Kato |
| 9,625,195 | B2 | 4/2017 | Hiraki et al. |
| 9,791,195 | B2 | 10/2017 | Okada et al. |
| 9,797,611 | B2 | 10/2017 | Gault |
| 9,909,785 | B2 | 3/2018 | Kato |
| 9,909,792 | B2 | 3/2018 | Oya |
| 9,920,960 | B2 | 3/2018 | Gerber et al. |
| 10,072,856 | B1 | 9/2018 | Akin et al. |
| 10,118,462 | B2 | 11/2018 | Kohigashi et al. |
| 10,119,738 | B2 | 11/2018 | Hammond et al. |
| 10,126,012 | B2 | 11/2018 | Ikawa et al. |
| 10,132,511 | B2 | 11/2018 | Tartakovsky |
| 10,151,663 | B2 | 12/2018 | Scancarello |
| 10,234,164 | B2 | 3/2019 | Takeuchi et al. |
| 10,345,004 | B1 | 7/2019 | Hern et al. |
| 10,408,484 | B2 | 9/2019 | Honda et al. |
| 10,465,961 | B2 | 11/2019 | Kujak |
| 10,480,807 | B2 | 11/2019 | Goel et al. |
| 10,488,065 | B2 | 11/2019 | Chen et al. |
| 10,488,072 | B2 | 11/2019 | Yajima et al. |
| 10,508,847 | B2 | 12/2019 | Yajima et al. |
| 10,514,176 | B2 | 12/2019 | Weinert |
| 10,527,310 | B2 | 1/2020 | Nagaoka et al. |
| 10,670,282 | B2 | 6/2020 | Yamada et al. |
| 10,677,679 | B2 | 6/2020 | Gupte et al. |
| 10,684,052 | B2 | 6/2020 | Walser et al. |
| 10,731,884 | B2 | 8/2020 | Blanton |
| 10,753,631 | B2 | 8/2020 | Ikawa et al. |
| 10,753,661 | B2 | 8/2020 | Hammond et al. |
| 10,767,882 | B2 | 9/2020 | Kowald et al. |
| 10,816,232 | B2 | 10/2020 | Crawford et al. |
| 10,866,002 | B2 | 12/2020 | Taras et al. |
| 10,866,004 | B2 | 12/2020 | Shiohama et al. |
| 10,871,314 | B2 | 12/2020 | Taras et al. |
| 10,914,482 | B2 | 2/2021 | Yamamoto et al. |
| 10,928,092 | B2 | 2/2021 | Yajima et al. |
| 10,935,260 | B2 | 3/2021 | Taras et al. |
| 10,935,454 | B2 | 3/2021 | Kester |
| 10,941,953 | B2 | 3/2021 | Goel et al. |
| 10,996,131 | B2 | 5/2021 | Mcquade et al. |
| 11,015,828 | B2 | 5/2021 | Sakae et al. |
| 11,015,852 | B2 | 5/2021 | Sakae et al. |
| 11,022,354 | B2 | 6/2021 | Yamada et al. |
| 11,041,647 | B2 | 6/2021 | Weinert |
| 11,041,666 | B2 | 6/2021 | Sakae et al. |
| 11,060,746 | B2 | 7/2021 | Maddox et al. |
| 11,060,775 | B2 | 7/2021 | Delgoshaei |
| 11,079,149 | B2 | 8/2021 | Papas et al. |
| 11,092,566 | B2 | 8/2021 | Chen et al. |
| 11,098,915 | B2 | 8/2021 | Crawford |
| 11,098,937 | B2 | 8/2021 | Uehara et al. |
| 11,125,457 | B1 | 9/2021 | Alfano et al. |
| 11,131,470 | B2 | 9/2021 | Minamida et al. |
| 11,231,197 | B2 | 1/2022 | Mcquade et al. |
| 11,248,816 | B2 | 2/2022 | Ikawa et al. |
| 11,268,718 | B2 | 3/2022 | Minamida et al. |
| 11,274,866 | B2 | 3/2022 | Yamada et al. |
| 11,274,871 | B2 | 3/2022 | Sakae et al. |
| 11,280,523 | B2 | 3/2022 | Sakae et al. |
| 11,287,153 | B2 | 3/2022 | Delgoshaei |
| 11,293,674 | B2 | 4/2022 | Yamada et al. |
| 11,326,798 | B2 | 5/2022 | Green et al. |
| 11,365,897 | B2 | 6/2022 | Blanton |
| 11,408,624 | B2 | 8/2022 | Hovardas et al. |
| 11,415,345 | B2 | 8/2022 | Yajima |
| 11,428,435 | B2 | 8/2022 | Eskew et al. |
| 11,441,803 | B2 | 9/2022 | Goel et al. |
| 11,629,866 | B2 | 4/2023 | Blanton et al. |
| 11,761,666 | B2 | 9/2023 | Atchison et al. |
| 11,933,523 | B2 | 3/2024 | Snider et al. |
| 11,965,672 | B2 | 4/2024 | Locke et al. |
| 2002/0078705 | A1 | 6/2002 | Schlosser et al. |
| 2003/0061822 | A1 | 4/2003 | Rafalovich |
| 2003/0221436 | A1 | 12/2003 | Xu |
| 2003/0221445 | A1 | 12/2003 | Smolinsky |
| 2004/0140082 | A1 | 7/2004 | Hua |
| 2005/0125083 | A1 | 6/2005 | Kiko |
| 2006/0010908 | A1 | 1/2006 | Taras et al. |
| 2006/0218949 | A1 | 10/2006 | Ellis et al. |
| 2006/0225445 | A1 | 10/2006 | Lifson et al. |
| 2007/0017243 | A1 | 1/2007 | Kidwell et al. |
| 2007/0074536 | A1 | 4/2007 | Bai |
| 2007/0146229 | A1 | 6/2007 | Lin |
| 2007/0251256 | A1 | 11/2007 | Pham et al. |
| 2007/0289319 | A1 | 12/2007 | Kim et al. |
| 2007/0295477 | A1 | 12/2007 | Mueller et al. |
| 2008/0016895 | A1 | 1/2008 | Kim et al. |
| 2008/0041072 | A1 | 2/2008 | Seefeldt |
| 2008/0173034 | A1 | 7/2008 | Shaw |
| 2008/0196418 | A1 | 8/2008 | Lifson et al. |
| 2008/0197206 | A1 | 8/2008 | Murakami et al. |
| 2008/0209930 | A1 | 9/2008 | Taras et al. |
| 2008/0256975 | A1 | 10/2008 | Lifson et al. |
| 2008/0282718 | A1 | 11/2008 | Beagle |
| 2008/0286118 | A1 | 11/2008 | Gu et al. |
| 2008/0289795 | A1 | 11/2008 | Hardin et al. |
| 2008/0296396 | A1 | 12/2008 | Corroy et al. |
| 2008/0302113 | A1 | 12/2008 | Yin et al. |
| 2008/0302118 | A1 | 12/2008 | Chen et al. |
| 2008/0302129 | A1 | 12/2008 | Mosemann et al. |
| 2008/0307813 | A1 | 12/2008 | Lifson et al. |
| 2008/0309210 | A1 | 12/2008 | Luisi et al. |
| 2009/0000611 | A1 | 1/2009 | Kaiser |
| 2009/0031739 | A1 | 2/2009 | Kasahara et al. |

(56) References Cited

U.S. PATENT DOCUMENTS

2009/0044550 A1 2/2009 Nishimura et al.
2009/0095000 A1 4/2009 Yoshimi et al.
2009/0100849 A1 4/2009 Nishimura et al.
2009/0107656 A1 4/2009 Marois
2009/0208331 A1 8/2009 Haley et al.
2009/0294097 A1 12/2009 Rini et al.
2009/0314014 A1 12/2009 Ericsson
2009/0314017 A1 12/2009 Nishimura et al.
2010/0005821 A1 1/2010 McCahill
2010/0005831 A1 1/2010 Vaisman et al.
2010/0024470 A1 2/2010 Lifson et al.
2010/0038052 A1 2/2010 Johnson et al.
2010/0058781 A1 3/2010 Lifson et al.
2010/0064710 A1 3/2010 Slaughter
2010/0064722 A1 3/2010 Taras
2010/0077788 A1 4/2010 Lewis
2010/0114384 A1 5/2010 Maxwell
2010/0132399 A1 6/2010 Mitra et al.
2010/0199715 A1 8/2010 Lifson et al.
2010/0251750 A1 10/2010 Lifson et al.
2010/0281894 A1 11/2010 Huff
2010/0287969 A1 11/2010 Ueda et al.
2010/0326100 A1 12/2010 Taras et al.
2011/0023515 A1 2/2011 Kopko et al.
2011/0036119 A1 2/2011 Fujimoto et al.
2011/0041523 A1 2/2011 Taras et al.
2011/0061413 A1 3/2011 Setoguchi
2011/0079032 A1 4/2011 Taras et al.
2011/0088426 A1 4/2011 Lochtefeid
2011/0094248 A1 4/2011 Taras et al.
2011/0094259 A1 4/2011 Lifson et al.
2011/0107780 A1 5/2011 Yamaguchi et al.
2011/0132007 A1 6/2011 Weyna et al.
2011/0174014 A1 7/2011 Scarcelia et al.
2011/0192176 A1 8/2011 Kim et al.
2011/0203299 A1 8/2011 Jing et al.
2011/0209490 A1 9/2011 Mijanovic et al.
2011/0259025 A1* 10/2011 Noh ..... F24D 3/18
62/160
2011/0289950 A1 12/2011 Kim et al.
2011/0289952 A1 12/2011 Kim et al.
2012/0011866 A1 1/2012 Scarcelia et al.
2012/0067965 A1 3/2012 Rajasekaran et al.
2012/0103005 A1 5/2012 Kopko et al.
2012/0139491 A1 6/2012 Eberhard et al.
2012/0198867 A1 8/2012 Ng et al.
2012/0205077 A1 8/2012 Zinger et al.
2012/0247134 A1 10/2012 Gurin
2012/0291460 A1 11/2012 Aoyagi
2013/0014451 A1 1/2013 Russell et al.
2013/0031934 A1 2/2013 Huff et al.
2013/0092329 A1 4/2013 Eastland
2013/0098085 A1 4/2013 Judge et al.
2013/0104574 A1 5/2013 Dempsey et al.
2013/0160985 A1* 6/2013 Chen ..... F25B 13/00
165/201
2013/0180266 A1* 7/2013 Bois ..... F25B 30/02
62/324.6
2013/0186116 A1 7/2013 Sami
2013/0269378 A1 10/2013 Wong
2013/0305756 A1 11/2013 Gomes et al.
2014/0013782 A1 1/2014 Kopko et al.
2014/0013788 A1 1/2014 Kopko et al.
2014/0033753 A1 2/2014 Lu et al.
2014/0033755 A1 2/2014 Wong
2014/0053585 A1 2/2014 Huff
2014/0060101 A1 3/2014 Styles et al.
2014/0123689 A1 5/2014 Ellis et al.
2014/0245770 A1 9/2014 Chen et al.
2014/0260392 A1 9/2014 Hawkins et al.
2015/0052937 A1 2/2015 Hung
2015/0059373 A1 3/2015 Maielio et al.
2015/0068740 A1 3/2015 Broder
2015/0204586 A1 7/2015 Burg et al.
2015/0252653 A1 9/2015 Shelton
2015/0285539 A1 10/2015 Kopko
2015/0330689 A1 11/2015 Kato et al.
2015/0338139 A1 11/2015 Xu et al.
2016/0076950 A1 3/2016 Jacquet
2016/0238276 A1 8/2016 Andrew et al.
2016/0265819 A1 9/2016 Durrani et al.
2017/0010029 A9 1/2017 Reytblat et al.
2017/0227250 A1 8/2017 Karamanos
2017/0336092 A1 11/2017 Ikawa et al.
2017/0370622 A1 12/2017 Shin et al.
2018/0010829 A1 1/2018 Taras et al.
2018/0128506 A1 5/2018 Taras et al.
2018/0313555 A1 11/2018 Henderson
2018/0328600 A1 11/2018 Swanson
2018/0334794 A1 11/2018 Janabi
2019/0032981 A1 1/2019 Hammond et al.
2019/0170600 A1 6/2019 Tice et al.
2019/0170603 A1 6/2019 Gupte et al.
2019/0178509 A1 6/2019 Taras et al.
2019/0346158 A1 11/2019 Kamada
2019/0351731 A1 11/2019 Jeong
2019/0353361 A1 11/2019 Attari
2020/0041187 A1 2/2020 Huckaby et al.
2020/0072510 A1 3/2020 Brown
2020/0263891 A1 8/2020 Noor et al.
2020/0355411 A1 11/2020 Inoue et al.
2020/0378667 A1 12/2020 Hammond et al.
2021/0018234 A1 1/2021 Lingrey et al.
2021/0041115 A1 2/2021 Yoshioka et al.
2021/0071920 A1 3/2021 Yamada et al.
2021/0095872 A1 4/2021 Taras et al.
2021/0131696 A1 5/2021 She et al.
2021/0131706 A1 5/2021 Yamada et al.
2021/0131709 A1 5/2021 Taras et al.
2021/0180807 A1 6/2021 Taras et al.
2021/0207831 A1 7/2021 Lord et al.
2021/0231330 A1 7/2021 Stephens et al.
2021/0270501 A1 9/2021 Brown et al.
2021/0293418 A1 9/2021 Fuse et al.
2021/0293430 A1 9/2021 Yamada
2021/0293446 A1 9/2021 Fard
2021/0302051 A1 9/2021 Yamada et al.
2021/0318012 A1 10/2021 Yamada et al.
2021/0325081 A1 10/2021 Kagawa et al.
2021/0341170 A1 11/2021 Hikawa et al.
2021/0348820 A1 11/2021 Kobayashi et al.
2021/0356154 A1 11/2021 Kobayashi et al.
2022/0090833 A1 3/2022 Yajima
2022/0099346 A1 3/2022 Alfano et al.
2022/0128277 A1 4/2022 Fukuyama et al.
2022/0186989 A1 6/2022 Yamaguchi et al.
2022/0243939 A1 8/2022 Notaro et al.
2022/0243940 A1 8/2022 Notaro et al.
2022/0243952 A1 8/2022 Kojima
2022/0247846 A1 8/2022 Lim
2022/0268492 A1 8/2022 Yajima
2022/0348052 A1 11/2022 Fox et al.
2022/0380648 A1 12/2022 Kumakura et al.
2023/0020557 A1 1/2023 Kaji et al.
2023/0052745 A1 2/2023 Kitagawa et al.
2023/0072254 A1 3/2023 Lamont et al.
2023/0094980 A1 3/2023 Birnkrant et al.
2023/0097829 A1 3/2023 Ohkubo et al.
2023/0097844 A1 3/2023 Birnkrant
2023/0106462 A1 4/2023 Hovardas et al.
2023/0160587 A1 5/2023 Delgoshaei et al.
2023/0184618 A1 6/2023 Gupte et al.
2023/0194137 A1 6/2023 Fan et al.
2023/0205237 A1 6/2023 Karamanos et al.
2023/0213252 A1 7/2023 Mcquade
2023/0213254 A1 7/2023 Ma
2023/0221025 A1 7/2023 Nakano et al.
2023/0221026 A1 7/2023 Blanton
2023/0235907 A1 7/2023 Dewald et al.
2023/0243534 A1 8/2023 Song et al.
2023/0243539 A1 8/2023 Buda
2023/0250981 A1 8/2023 Notaro et al.

(56) References Cited

U.S. PATENT DOCUMENTS

| | | | |
|---|---|---|---|
| 2023/0266026 | A1 | 8/2023 | Notaro et al. |
| 2024/0003584 | A1 | 1/2024 | Willhite et al. |

FOREIGN PATENT DOCUMENTS

| | | | |
|---|---|---|---|
| CN | 1987397 | A | 6/2007 |
| CN | 201944952 | U | 8/2011 |
| CN | 102353126 | A | 2/2012 |
| CN | 203231582 | U | 10/2013 |
| CN | 103471275 | A | 12/2013 |
| CN | 203396155 | U | 1/2014 |
| CN | 203432025 | U | 2/2014 |
| CN | 115435444 | A | 12/2022 |
| CN | 115468229 | A | 12/2022 |
| CN | 115493250 | A | 12/2022 |
| CN | 115523604 | A | 12/2022 |
| CN | 115638523 | A | 1/2023 |
| CN | 115711454 | A | 2/2023 |
| CN | 218511135 | U | 2/2023 |
| CN | 115751508 | A | 3/2023 |
| CN | 115751603 | A | 3/2023 |
| CN | 115854484 | A | 3/2023 |
| CN | 115854488 | A | 3/2023 |
| CN | 218672483 | U | 3/2023 |
| CN | 115930357 | A | 4/2023 |
| CN | 115978709 | A | 4/2023 |
| CN | 115978710 | A | 4/2023 |
| CN | 116007066 | A | 4/2023 |
| CN | 116025999 | A | 4/2023 |
| CN | 218915295 | U | 4/2023 |
| CN | 116085938 | A | 5/2023 |
| CN | 116085939 | A | 5/2023 |
| CN | 116123663 | A | 5/2023 |
| CN | 116221902 | A | 6/2023 |
| CN | 116241979 | A | 6/2023 |
| CN | 116242010 | A | 6/2023 |
| CN | 116294062 | A | 6/2023 |
| CN | 116294111 | A | 6/2023 |
| CN | 116336607 | A | 6/2023 |
| CN | 219415010 | U | 7/2023 |
| CN | 116538638 | A | 8/2023 |
| CN | 116558042 | A | 8/2023 |
| CN | 116608539 | A | 8/2023 |
| CN | 219693510 | U | 9/2023 |
| DE | 102007050446 | A1 | 4/2009 |
| DE | 202022106612 | U1 | 3/2023 |
| EP | 134015 | | 3/1985 |
| EP | 1736720 | A2 | 12/2006 |
| EP | 1983275 | A1 | 10/2008 |
| EP | 2108897 | B1 | 6/2017 |
| EP | 3358279 | B1 | 6/2020 |
| EP | 3447403 | B1 | 6/2021 |
| EP | 4036486 | A1 | 8/2022 |
| EP | 4180727 | A1 | 5/2023 |
| EP | 4194769 | A1 | 6/2023 |
| ES | 2946857 | A1 | 7/2023 |
| IN | 201917005053 | A | 4/2019 |
| IN | 201917012216 | A | 7/2019 |
| IN | 201917018373 | A | 7/2019 |
| IN | 202117017393 | A | 1/2022 |
| IN | 202117017768 | A | 1/2022 |
| IN | 202117018393 | A | 1/2022 |
| IN | 202118001637 | A | 1/2022 |
| JP | 2000046417 | | 2/2000 |
| JP | 2000274786 | | 10/2000 |
| JP | 2000314563 | | 11/2000 |
| JP | 2001248931 | | 9/2001 |
| JP | 3610812 | B2 | 1/2005 |
| JP | 3744330 | B2 | 2/2006 |
| JP | 2010101515 | A | 5/2010 |
| JP | 2010101606 | A | 5/2010 |
| JP | 2010133601 | A | 6/2010 |
| JP | 2010230181 | A | 10/2010 |
| JP | 2015094574 | A | 5/2015 |
| JP | 2015175531 | A | 10/2015 |
| JP | 2017075760 | A | 4/2017 |
| JP | 2020051737 | A | 4/2020 |
| JP | 2021103053 | A | 7/2021 |
| JP | 2022039608 | A | 3/2022 |
| JP | 2022176373 | A | 11/2022 |
| JP | 2023025165 | A | 2/2023 |
| JP | 2023060225 | A | 4/2023 |
| JP | 2023076482 | A | 6/2023 |
| JP | 2023116473 | A | 8/2023 |
| KR | 100963221 | B1 | 6/2010 |
| KR | 20190090972 | A | 8/2019 |
| KR | 102551281 | B1 | 7/2023 |
| KR | 102551284 | B1 | 7/2023 |
| KR | 102551286 | B1 | 7/2023 |
| KR | 102569930 | B1 | 8/2023 |
| WO | 9600370 | | 1/1996 |
| WO | 2001/90663 | | 11/2001 |
| WO | 2006/033782 | | 3/2006 |
| WO | 2007007576 | A1 | 1/2007 |
| WO | 2008/045086 | | 4/2008 |
| WO | 2008/048252 | | 4/2008 |
| WO | 2010/005918 | | 1/2010 |
| WO | 2010004716 | A1 | 1/2010 |
| WO | 2010/054498 | | 5/2010 |
| WO | 2010/104709 | | 9/2010 |
| WO | 2013/142760 | | 9/2013 |
| WO | 2014/031559 | A1 | 2/2014 |
| WO | 2014/031708 | A1 | 2/2014 |
| WO | 2016158092 | A1 | 10/2016 |
| WO | 2016159152 | A1 | 10/2016 |
| WO | 2017138820 | A1 | 8/2017 |
| WO | 2018135850 | A1 | 7/2018 |
| WO | 2020067039 | A1 | 4/2020 |
| WO | 2020158653 | A1 | 8/2020 |
| WO | 2020179826 | A1 | 9/2020 |
| WO | 2021050617 | A1 | 3/2021 |
| WO | 2021050618 | A1 | 3/2021 |
| WO | 2021050886 | A1 | 3/2021 |
| WO | 2021054199 | A1 | 3/2021 |
| WO | 2021106957 | A1 | 6/2021 |
| WO | 2021125354 | A1 | 6/2021 |
| WO | 2021172516 | A1 | 9/2021 |
| WO | 2021215528 | A1 | 10/2021 |
| WO | 2021234857 | A1 | 11/2021 |
| WO | 2022064784 | A1 | 3/2022 |
| WO | 2022168305 | A1 | 8/2022 |
| WO | 2023059724 | A1 | 4/2023 |
| WO | 2023069273 | A1 | 4/2023 |
| WO | 2023084127 | A1 | 5/2023 |
| WO | 2023127329 | A1 | 7/2023 |
| WO | 2023127345 | A1 | 7/2023 |
| WO | 2023140145 | A1 | 7/2023 |
| WO | 2023157565 | A1 | 8/2023 |
| WO | 2023157568 | A1 | 8/2023 |
| WO | 2023161248 | A1 | 8/2023 |
| WO | 2023161249 | A1 | 8/2023 |

OTHER PUBLICATIONS

"Economized Vapor Injection (EVI) Compressors," Emerson Climate Technologies Application Engineering Bulletin AE4-1327 R2, Revised Sep. 2006 (9 pages).

"Enhanced Vapour injection (EVI) for ZH*KVE Scroll Compressors," Emerson Climate Technologies—Technical Information, C7.4. 3/1107-0512/E, May 2012 (10 pages).

"Heat Pump Mechanics" http://www.geo4va.vt.edu/A3/A3.htm#A3sec3c (Accessed Apr. 20, 2011) (19 pages).

"Heat pumps in residential and commercial buildings" http://www.heatpumpcentre.org/en/aboutheatpumps/heatpumpsinresidential/Sidor/default.aspx (Accessed Apr. 20, 2011) (2 pages).

B.P. Rasmussen et al., "Model-Driven System Identification of Transcritical Vapor Compression Systems," IEEE Transactions on Control Systems Technology, May 2005, pp. 444-451, vol. 13 (8 pages).

Ekaterina Vi Nogradova, "Economizers in Chiller Systems," Bachelor's Thesis, Mikkelin Ammattikorkeakoulu, Nov. 2012 (50 pages).

(56) References Cited

OTHER PUBLICATIONS

Haraldsson et al., "Measurement of Performance and Evaluation of a Heat Pump—with Scroll Compressor EVI and Economizer," Lunds Institute of Technology, 2006 (4 pages).
Honeywell, VFF1, VFF2, VFF3, VFF6 Resilient Seat Butterfly Valves with Flanged Connections Jan. 2013, p. 1, 1st column, last paragraph. (Year: 2013) (20 pages).
International Preliminary Report on Patentability issued in International Application No. PCT/US2013/033433 dated Sep. 23, 2014 (7 Pages).
International Search Report and Written Opinion issued in International Application No. PCT/US2013/033433 dated Aug. 9, 2013 (11 Pages).
John P. Elson et al., "Scroll Technology: An Overview of Past, Present, and Future Developments," International Compressor Engineering Conference, 2008, Paper 1871 (9 pages).
Korean Intellectual Property Office, International Search Report, in International Application No. PCT/US2009/049734 (dated Jan. 20, 2010) (2 pages).
Korean Intellectual Property Office, International Search Report in International Application No. PCT/US2010/026010 (dated Sep. 28, 2010) (2 pages).
Lund et al., "Geothermal (Ground-Source Heat Pumps—A World Overview," GHC Bulletin, Sep. 2004 (edited and updated version of the article from Renewal Energy World, (Jul.-Aug. 2003), vol. 6 No. 4) (10 pages).
Michael F. Taras, "Reheat Which Concept is Best," ASHRAE Journal: 35-40 (Dec. 2004) (7 pages).
Murphy et al., "Air-Source Integrated Heat Pump for Net-Zero-Energy Houses Technology Status Report," *Oak Ridge National Laboratory*, ORNL-TM-2007-112 (Jul. 2007) (93 pages).
Murphy et al., "Ground-Source Integrated Heat Pump for Net-Zero-Energy Houses Technology Status Report," *Oak Ridge National Laboratory*, ORNL-TM-2007-177 (Dec. 2007) (78 pages).
Third Pasty Submission dated Nov. 10, 2014 filed in U.S. Appl. No. 13/848,342 (13 Pages).
Tolga N. Aynur, "Variable Refrigerant Flow Systems: A Review, Energy and Buildings," Jan. 2010, pp. 1106-1112, vol. 42 (7 pages).
Wei Yang et al., "The Design Method of U-Bend Geothermal Heat Exchanger of DX-GCHP in Cooling Model," IEEE, 2011, pp. 3635-3637 (English Abstract) (3 pages).
Amir Rafati et al., "Fault Detection and Efficiency Assessment for HVAC Systems Using Non-Intrusive Load Monitoring: A Review," Energies 15.1 (2022): 341. (16 pages).
Milan Jain et al., "Beyond control: Enabling smart thermostats for leakage detection," Proceedings of the ACM on Interactive, Mobile, Wearable and Ubiquitous Technologies 3.1 (2019): 1-21. (21 pages).
Shen Tian, et al., "A study on a real-time leak detection method for pressurized liquid refrigerant pipeline based on pressure and flow rate," Applied Thermal Engineering 95 (2016): 462-470. (17 pages).
J. Navarro-Esbri et al., "A vapour compression chiller fault detection technique based on adaptative algorithms. Application to on-line refrigerant leakage detection," International Journal of Refrigeration 29.5 (2006): 716-723. (8 pages).
Animesh Pal et al., "Environmental Assessment and Characteristics of Next Generation Refrigerants," Kyushu University Institutional Repository, (2018): 58-66. (10 pages).
Matthew Wiggins, Ph.D et al., "HVAC Fault Detection," ASHRAE Journal 54.2 (2012): 78-80. (3 pages).
Shunsuke Kimura, "Development of a Remote Refrigerant Leakage Detection System for VRFs and Chillers," Purdue University—International Refrigeration and Air Conditioning Conference Paper 2304, 2022. (10 pages).
Rohit Chintala et al., "Automated fault detection of residential air-conditioning systems using thermostat drive cycles," Energy and Buildings 236 (2021): 110691. (28 pages).
Xudong Wang et al., "A2L Refrigerants Leaks and Ignitions Testing under Whole Room Scale," Purdue University—International Refrigeration and Air Conditioning Conference Paper 1849, 2018. (11 pages).
International Preliminary Report on Patentability mailed Sep. 9, 2022 for PCT Application No. PCT/US2021/020017 (7 pages).
International Search Report and Written Opinion mailed May 19, 2021 for PCT Application No. PCT/US2021/020017 (7 pages).
Taras, Michael F., "Comparison of Reheat Strategies for Constant Volume Rooftop Units", Carrier Corporation, Mar. 2008, 10p.
Baldini, Luca et al. , "Decentralized cooling and dehumidification with a 3 stage LowEx heat exchanger for free reheating", Elsevier, Energy and Buildings, v76, Jun. 2014, pp. 270-277.
Bobelin, Damien et al., "Experimental Results of a Newly Developed Very High Temperature Industrial Heat Pump (140 C) Equipped With Scroll Compressors and Working With a New Blend Refrigerant", Purdue University, Purdue e-Pubs, International Refrigeration and Air Conditioning Conference, School of Mechanical Engineering, 2012, 11p.
Han, Xing et al., "A novel system of the isothermal dehumidification in a room air-conditioner", Elsevier, Energy and Buildings v 57, 2013, pp. 14-19.
Mayhew, Balwin, "Dehumidification using CHW Return Based Reheat", Decarb Healthcare, A Guidebook for Decarbonizing Healthcare, Sep. 30, 2023, 6p.
Johnson Controls, "Premier 25 Ton to 80 Ton Rooftop Units R-410A Start-Up and Operation Guide", Form No. 5881421-JSG-A-02222, issued Feb. 2, 2022, 170p.

* cited by examiner

Cooling Mode

Cooling Mode with Active Desuperheater and Expansion Valve Boost

AIR CONDITIONING SYSTEM WITH CAPACITY CONTROL AND CONTROLLED HOT WATER GENERATION

CROSS-REFERENCE TO RELATED APPLICATION

This application is a divisional of U.S. patent application Ser. No. 16/897,252, filed on Jun. 9, 2020, which claims the benefit of U.S. Provisional Application No. 62/874,310, filed on Jul. 15, 2019. All of these applications are incorporated by reference herein in their entirety.

BACKGROUND

The instant disclosure relates generally to heating, ventilation, and air conditioning (HVAC) systems, including heat pump systems, as well as methods of operating such systems.

SUMMARY

Disclosed are various embodiments of a heating, ventilation, and air conditioning system for conditioning air in a space and optionally for heating water for domestic, commercial, or industrial process uses.

In one embodiment, an HVAC system for conditioning air in a space includes a refrigerant circuit that fluidly interconnects: (a) a compressor to circulate a refrigerant through the refrigerant circuit, the compressor having a discharge outlet port and an suction inlet port; (b) a source heat exchanger operable as either a condenser or an evaporator for exchanging heat with a source fluid; (c) a space heat exchanger operable as either a condenser or an evaporator for heating or cooling air in the space; (d) a desuperheater heat exchanger operable as a condenser for heating water; (e) a first reversing valve positioned downstream of the compressor to alternately direct the refrigerant from the discharge outlet port of the compressor to one of a second reversing valve, a first 3-way valve, and a second 3-way valve and to alternately return the refrigerant from one of the second reversing valve and the second 3-way valve to the suction inlet port of the compressor, wherein the first 3-way valve is configured to selectively direct the refrigerant to the desuperheater heat exchanger from one of the first and second reversing valves, and the second 3-way valve is configured to selectively direct the refrigerant to the first reversing valve and the space heat exchanger; (f) first and second expansion devices positioned between the source and space heat exchangers; (g) first and second expansion device bypass circuits configured to allow the refrigerant to bypass the first and second expansion devices, respectively, the first and second expansion device bypass circuits comprising first and second check valves, respectively, to control a direction of the refrigerant in the first and second expansion device bypass circuits; and (h) a first bi-directional valve positioned downstream of the second reversing valve to selectively convey the refrigerant to at least one of the first 3-way valve, the second 3-way valve, and a second bi-directional valve, wherein the second bi-directional valve modulates exchange of heat in the space heat exchanger when the space heat exchanger is operating as an evaporator and eliminates flashing of the refrigerant entering the source heat exchanger when the source heat exchanger is operating as an evaporator.

The compressor may be a variable capacity compressor. The HVAC system may include a liquid pump associated with the source heat exchanger and the liquid pump may be a variable capacity pump. The source heat exchanger may be a refrigerant-to-liquid heat exchanger configured to exchange heat between the refrigerant in the refrigerant circuit and the source fluid in a source loop. The space heat exchanger may be a refrigerant-to-air heat exchanger. The desuperheater heat exchanger may be a refrigerant-to-liquid heat exchanger configured to exchange heat between the refrigerant in the refrigerant circuit and water in a storage loop.

The HVAC system may include a fan driven by a variable speed motor, and the fan may be configured to flow air over a portion of the space heat exchanger. The first and second expansion devices may be fixed orifice devices, mechanical valves, or electronic valves. The HVAC system may include a storage tank for storing heated water. The HVAC system may include a variable speed water pump for circulating heated water in the storage loop and through the desuperheater heat exchanger and a variable speed source fluid pump for circulating the source fluid in the source loop and through the source heat exchanger.

The HVAC system may include a third bi-directional valve positioned upstream of the second reversing valve to temporarily divert the refrigerant away from the second reversing valve when switching the second reversing valve from one operating configuration to another, and a fourth bi-directional valve positioned downstream of the second reversing valve and upstream of the first bi-directional valve to divert partially condensed refrigerant from the desuperheater heat exchanger to one of the first and second expansion devices. The HVAC system may include a controller comprising a processor and memory on which one or more software programs are stored. The controller may be configured to control operation of the compressor, the first and second reversing valves, the first and second 3-way valves, the first and second expansion devices, the first and second bi-directional valves, a first variable speed pump for circulating water through the desuperheater heat exchanger, and a second variable speed pump for circulating the source fluid through the source heat exchanger.

To operate the HVAC system in a space cooling mode: (a) the first reversing valve diverts the refrigerant from the compressor to the second reversing valve and from the second 3-way valve to the compressor, (b) the second reversing valve diverts the refrigerant from the first reversing valve to the source heat exchanger configured as a condenser, (c) the first and second bi-directional valves are closed, (d) the first expansion device is closed and the refrigerant is diverted through the first check valve via the first expansion device bypass circuit, (e) the second expansion device is open and directs the refrigerant to the space heat exchanger configured as an evaporator, and the second 3-way valve diverts the refrigerant from the space heat exchanger to the first reversing valve.

To operate the HVAC system in a cooling mode with an active desuperheater: (a) the first reversing valve diverts the refrigerant from the compressor to the second reversing valve and from the second 3-way valve to the compressor, (b) the second reversing valve diverts the refrigerant from the first reversing valve to the first bi-directional valve and from the desuperheater heat exchanger to the source heat exchanger configured as a condenser, (c) the first bi-directional valve is open, (d) the second bi-directional valve is closed, (e) the first expansion device is closed and the refrigerant is diverted through the first check valve via the first expansion device bypass circuit, (f) the second expansion device is open and directs the refrigerant to the space heat exchanger configured as an evaporator, and (g) the second 3-way valve diverts the refrigerant from the space heat exchanger to the first reversing valve.

To operate the HVAC system in a cooling mode with an active desuperheater and with space heat exchanger tempering: (a) the first reversing valve diverts the refrigerant from the compressor to the second reversing valve and from the second 3-way valve to the compressor, (b) the second reversing valve diverts the refrigerant from the first reversing valve to the first bi-directional valve and from the desuperheater heat exchanger to the source heat exchanger configured as a condenser, (c) the first bi-directional valve and the second bi-directional valve are open and a first portion of the refrigerant from the first bi-directional valve is conveyed to the first 3-way valve and a second portion of the refrigerant is conveyed to the second bi-directional valve, wherein the first portion of the refrigerant is conveyed to the desuperheater heat exchanger and then to the source heat exchanger via the second reversing valve, (d) the first expansion device is closed and the first portion of the refrigerant is conveyed from the source heat exchanger through the first check valve via the first expansion device bypass circuit and to the second expansion device, (e) the second expansion device is open, and the first portion of the refrigerant from the second expansion device and the second portion of the refrigerant from the second bi-directional valve are mixed and conveyed to the space heat exchanger configured as an evaporator, and (f) the second 3-way valve diverts the refrigerant from the space heat exchanger to the first reversing valve.

To operate the HVAC system in a space heating mode: (a) the first reversing valve diverts the refrigerant from the compressor to the second 3-way valve and from the second reversing valve to the compressor, (b) the second reversing valve diverts the refrigerant from the source heat exchanger configured as an evaporator to the first reversing valve, (c) the second 3-way valve diverts the refrigerant to the space heat exchanger configured as a condenser, (d) the first and second bi-directional valves are closed, (e) the second expansion device is closed and the refrigerant is diverted through the second check valve via the second expansion device bypass circuit, (f) the first expansion device is open and directs the refrigerant to the source heat exchanger configured as an evaporator, and (g) the refrigerant leaving the source heat exchanger is directed to the second reversing valve.

To operate the HVAC system in a heating mode with an active desuperheater: (a) the first reversing valve diverts the refrigerant from the compressor to the first 3-way valve and from the second reversing valve to the compressor, (b) the first 3-way valve diverts the refrigerant from the first reversing valve to the desuperheater heat exchanger, and the refrigerant leaving the desuperheater heat exchanger is conveyed to the second reversing valve, (c) the second reversing valve diverts the refrigerant from the desuperheater heat exchanger to the first bi-directional valve and from the source heat exchanger to the first reversing valve, (d) the first bi-directional valve is open and the refrigerant from the first bi-directional valve is conveyed to the second 3-way valve, (e) the second 3-way valve diverts the refrigerant to the space heat exchanger configured as a condenser, (f) the second bi-directional valve is closed, (g) the second expansion device is closed and the refrigerant is conveyed through the second check valve via the second expansion device bypass circuit, (h) the first expansion device is open and directs the refrigerant to the source heat exchanger configured as an evaporator, and (i) the refrigerant leaving the source heat exchanger is directed to the second reversing valve.

To operate the HVAC system in a space heating mode with an active desuperheater and expansion device boost: (a) the first reversing valve diverts the refrigerant from the compressor to the first 3-way valve and from the second reversing valve to the compressor, (b) the first 3-way valve diverts the refrigerant from the first reversing valve to the desuperheater heat exchanger, and the refrigerant leaving the desuperheater heat exchanger is conveyed to the second reversing valve, (c) the second reversing valve diverts the refrigerant from the desuperheater heat exchanger to the first bi-directional valve and from the source heat exchanger to the first reversing valve, (d) the first bi-directional valve and the second bi-directional valve are open and a first portion of the refrigerant from the first bi-directional valve is conveyed to the second 3-way valve and a second portion of the refrigerant is conveyed to the second bi-directional valve, (e) the second 3-way valve diverts the first portion of the refrigerant to the space heat exchanger configured as a condenser, wherein the second portion of the refrigerant from the second bi-directional valve is mixed with the first portion of the refrigerant from the space heat exchanger configured as a condenser and conveyed through the second check valve via the second expansion device bypass circuit to the first expansion device, (f) the first expansion device is open and directs the refrigerant to the source heat exchanger configured as an evaporator, and (g) the refrigerant leaving the source heat exchanger is directed to the second reversing valve.

In another embodiment, an HVAC system for conditioning air in a space includes: (a) a compressor to circulate a refrigerant through a refrigerant circuit, the compressor having a discharge outlet port and an suction inlet port; (b) a source heat exchanger operable as either a condenser or an evaporator for exchanging heat with a source fluid; (c) a first load heat exchanger operable as either a condenser or an evaporator for heating or cooling air in the space; (d) a second load heat exchanger operable as a condenser for heating water; (e) a first reversing valve positioned downstream of the compressor to alternately direct the refrigerant from the discharge outlet port of the compressor to one of a second reversing valve, a first 3-way valve, and a second 3-way valve and to alternately return the refrigerant from one of the second reversing valve and the second 3-way valve to the suction inlet port of the compressor, wherein the first 3-way valve is configured to selectively direct the refrigerant to the second load heat exchanger from one of the first and second reversing valves, and the second 3-way valve is configured to selectively direct the refrigerant to the first reversing valve and the first load heat exchanger; (e) a bi-directional expansion valve positioned between the source and first load heat exchangers; (f) a first bi-directional valve positioned downstream of the second reversing valve to selectively convey the refrigerant to at least one of the first 3-way valve, the second 3-way valve, and a second bi-directional valve, wherein the second bi-directional valve modulates exchange of heat in the first load heat exchanger when the first load heat exchanger is operating as an evaporator and controls flashing of the refrigerant entering the source heat exchanger when the source heat exchanger is operating as an evaporator; and (g) a controller comprising a processor and memory on which one or more software programs are stored, the controller configured to control operation of the compressor, the first and second reversing valves, the first and second 3-way valves, the bi-directional expansion valve, the first and second bi-directional valves, a first variable speed pump for circulating water through the second load heat exchanger, and a second variable speed pump for circulating the source fluid through the source heat exchanger.

The compressor may be a variable capacity compressor. The HVAC system may include a liquid pump associated with the source heat exchanger and the pump may be a variable capacity pump. The source heat exchanger may be a refrigerant-to-liquid heat exchanger configured to exchange heat between the refrigerant in the refrigerant circuit and the source fluid in a source loop. The space heat exchanger may be a refrigerant-to-air heat exchanger. The desuperheater heat exchanger may be a refrigerant-to-liquid heat exchanger configured to exchange heat between the refrigerant in the refrigerant circuit and water in a storage loop.

The HVAC system may include a fan driven by a variable speed motor, and the fan may be configured to flow air over a portion of the space heat exchanger. The HVAC system may include a storage tank for storing heated water. The HVAC system may include a variable speed water pump for circulating heated water in the storage loop and through the desuperheater heat exchanger and a variable speed source fluid pump for circulating the source fluid in the source loop and through the source heat exchanger. The space heat exchanger may alternatively be a refrigerant-to-liquid heat exchanger for exchanging heat with a liquid for any use, including conditioning air in a space or for industrial purposes.

The HVAC system may include a third bi-directional valve positioned upstream of the second reversing valve to temporarily divert the refrigerant away from the second reversing valve when switching the second reversing valve from one operating configuration to another, and a fourth bi-directional valve positioned downstream of the second reversing valve and upstream of the first bi-directional valve to divert partially condensed refrigerant from the desuperheater heat exchanger to one of the first and second expansion devices.

The HVAC system may be operated in any one of a plurality of operating modes, including: (a) a space cooling mode, (b) a cooling mode with an active desuperheater, (c) a cooling mode with an active desuperheater and with space heat exchanger tempering, (d) a space heating mode, (e) a heating mode with an active desuperheater, (f) a heating mode with an active desuperheater and expansion valve boost.

DETAILED DESCRIPTION

Figure 1:
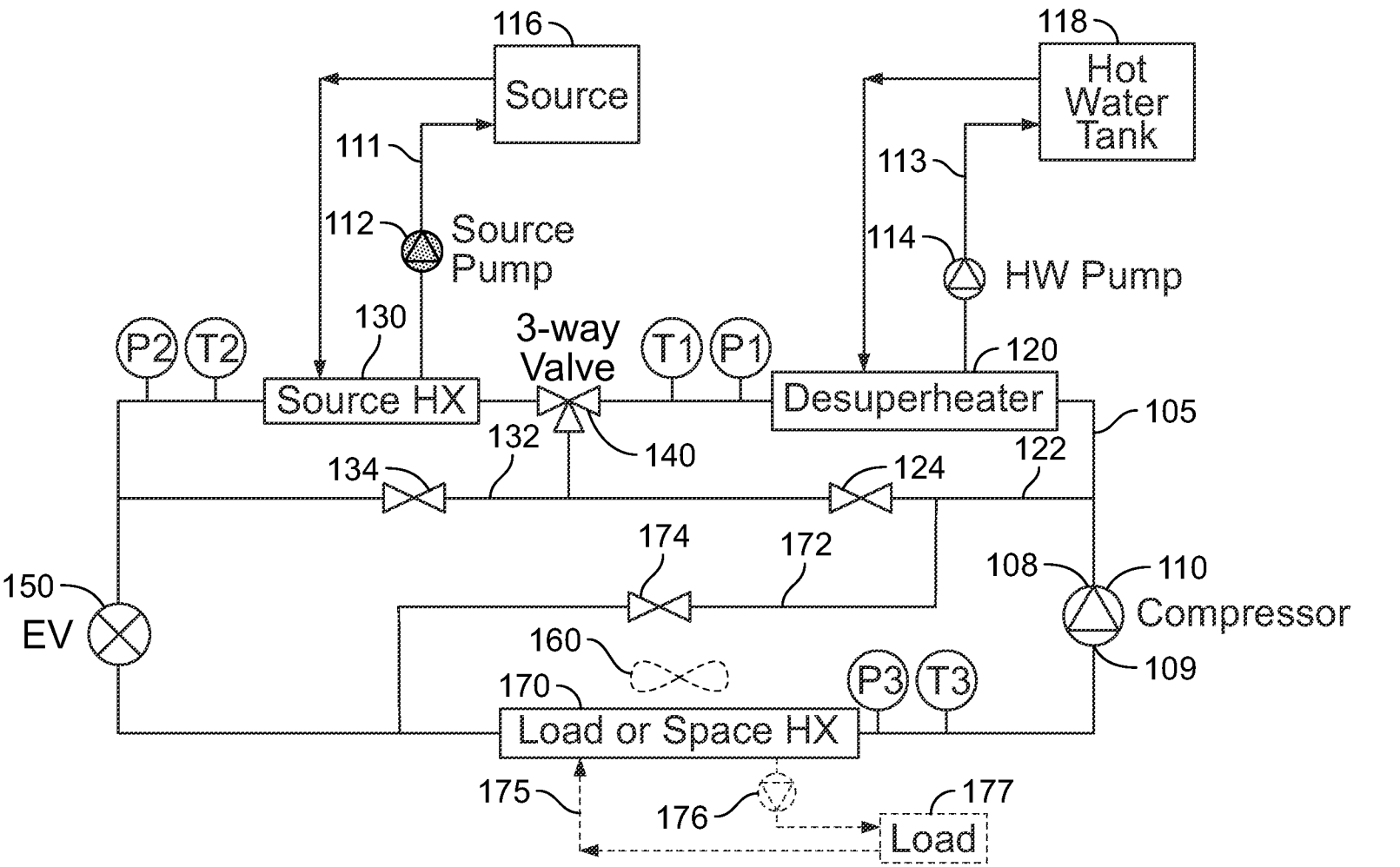
FIG. 1 is a schematic showing an embodiment of an HVAC system of the instant disclosure.

Although the figures and the instant disclosure describe one or more embodiments of a heat pump system, one of ordinary skill in the art would appreciate that the teachings of the instant disclosure would not be limited to these embodiments. It should be appreciated that any of the features of an embodiment discussed with reference to the figures herein may be combined with or substituted for features discussed in connection with other embodiments in this disclosure.

The instant disclosure provides improved and flexible HVAC operation to condition air in a space and optionally to heat water for domestic, commercial, or industrial process uses. The various embodiments disclosed herein take advantage of properties of the compressor's discharge of hot gas flow through an auxiliary heat exchanger (e.g., desuperheater) coupled to a water flow stream to heat the water when hot water is demanded. The various embodiments disclosed herein offer the advantages of:

- Having a large capacity for hot water generation in comparison to the size of the system to allow for faster re-filling of a hot water reservoir and to maximize hot water recovery time at peak hot water demand.
- Improved operating efficiencies across a broad range of environmental conditions, where the system may be configured to maintain efficient control throughout various operating conditions and part-load conditions. The various embodiments disclosed herein provide extremely high energy efficiency by controlling condensing temperatures to achieve peak system performance.
- Improved control of pressures along the refrigerant circuit to maintain consistent energy usage efficiency under part-load conditions.

By using a desuperheater heat exchanger acting as a condenser, the system optimizes space and improves heat exchange.

Improved evaporator frost and freeze prevention to avoid frosted coils and associated downtime or defrost requirements.

The embodiments of an HVAC system disclosed herein may provide operational flexibility via a modulating, pulse width modulating (PWM) or rapid cycle solenoid valve to divert at least a portion of the refrigerant from the refrigerant circuit to one or more bypass circuits to bypass, for example, an inactive heat exchanger or to modulate or temper heat exchange by a particular heat exchanger. Alternatively or additionally, an ON-OFF 3-way valve and a bypass valve may be replaced by the modulating, PWM or rapid cycle solenoid 3-way valve. A controller comprising a processor coupled to memory on which one or more software algorithms are stored may process and issue commands to open, partially open, or close any of the valves disclosed herein. Open or closed feedback loops may be employed to determine current and desired valve positions.

The embodiments of an HVAC system disclosed herein may employ variable speed or multi-speed hot water and/or source fluid pumps, fan and/or blower motor, and compressor to control operation of these components to provide the desired system performance.

Any of the expansion valves disclosed herein may be any type of expansion device, including a thermostatic expansion valve, and can be electronic, mechanical, electromechanical, or fixed orifice type. All of the embodiments described herein provide improved comfort level, system performance, and system reliability.

In one embodiment, a vapor compression circuit of an HVAC system capable of multiple operating modes to heat or cool a space and optionally to heat water includes a compressor, a desuperheater heat exchanger (or simply "desuperheater") operable as a condenser to heat water for domestic, commercial and/or industrial process purposes, a source heat exchanger operable as either a condenser or an evaporator, a space heat exchanger operable as either a condenser or an evaporator, a 3-way valve positioned between the desuperheater and the source heat exchanger, an expansion valve positioned between the source heat exchanger and the space heat exchanger, a plurality of bi-directional valves positioned along a plurality of bypass circuits, a plurality of temperature and pressure sensors positioned at various locations along the main refrigerant circuit and/or bypass circuits, and a controller configured to operate one or more of these components. This embodiment may include one or more reversing valves to reverse the flow of refrigerant to enable the HVAC system to operate in one or more space cooling and space heating operating modes, as in a heat pump. This embodiment may also include one or more diverters or diverter valves to modulate or temper the heat exchange by the space heat exchanger.

In one or more operating modes when the desuperheater is active (i.e., functioning as a heat exchanger), the desuperheater is positioned downstream of the compressor and upstream of the 3-way valve with respect to flow of refrigerant in the refrigerant circuit. In one or more operating modes when the source heat exchanger is active, the source heat exchanger is positioned downstream of the 3-way valve and upstream of the expansion valve with respect to flow of refrigerant in the refrigerant circuit. In one or more space cooling operating modes, the space heat exchanger is active and is positioned downstream of the expansion valve and upstream of the compressor. In one or more operating modes when the desuperheater is inactive, refrigerant flow bypasses the desuperheater and is routed from the compressor to the 3-way valve. In some embodiments, at least a portion of the refrigerant leaving the compressor may be diverted from the refrigerant being directed to the 3-way valve when the desuperheater is inactive or to the desuperheater when the desuperheater is active and direct that diverted portion of the refrigerant to the space heat exchanger to modulate or temper the heat exchange by the space heat exchanger. The relative positions of at least some of these components are swapped if a reversing valve is employed to reverse the direction of refrigerant to switch from a cooling mode to a heating mode and vice versa.

In another embodiment, a vapor compression circuit of an HVAC system capable of multiple operating modes to heat or cool a space and optionally to heat water includes a compressor, a pair of reversing valves, a pair of 3-way valves, a pair of expansion valves (one active and one inactive in any given operating mode), a desuperheater heat exchanger operable to heat water for domestic, commercial and/or industrial process purposes, a source heat exchanger operable as either a condenser or an evaporator, a space heat exchanger operable as either a condenser or an evaporator, a pair of check valves, a plurality of bi-directional valves, a plurality of temperature and pressure sensors positioned at various locations along the refrigerant circuit and/or bypass circuits, and a controller configured to operate one or more of these components.

Figure 2:
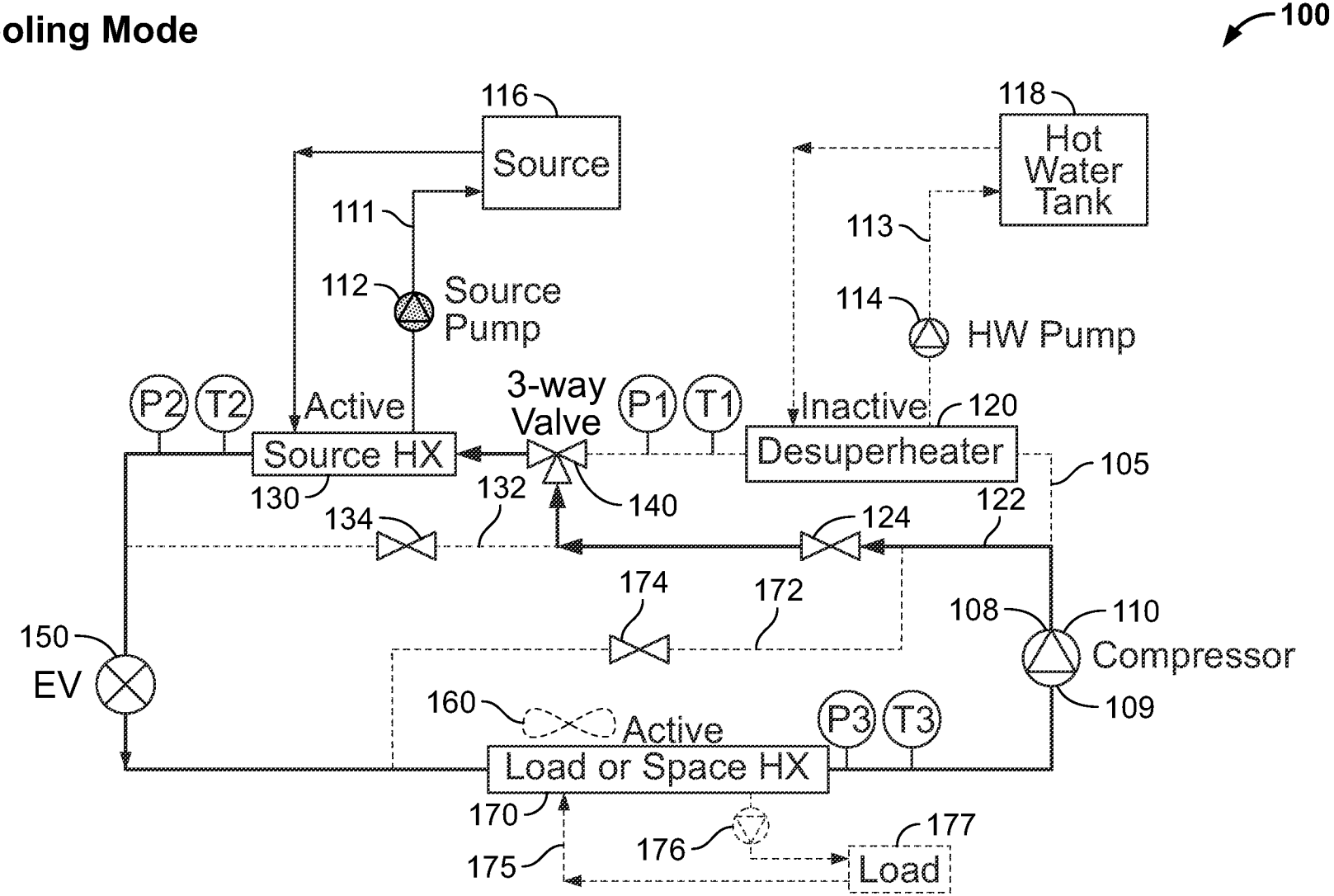
FIG. 2 is a schematic showing the HVAC system of FIG. 1 in a cooling mode.
Figure 3:
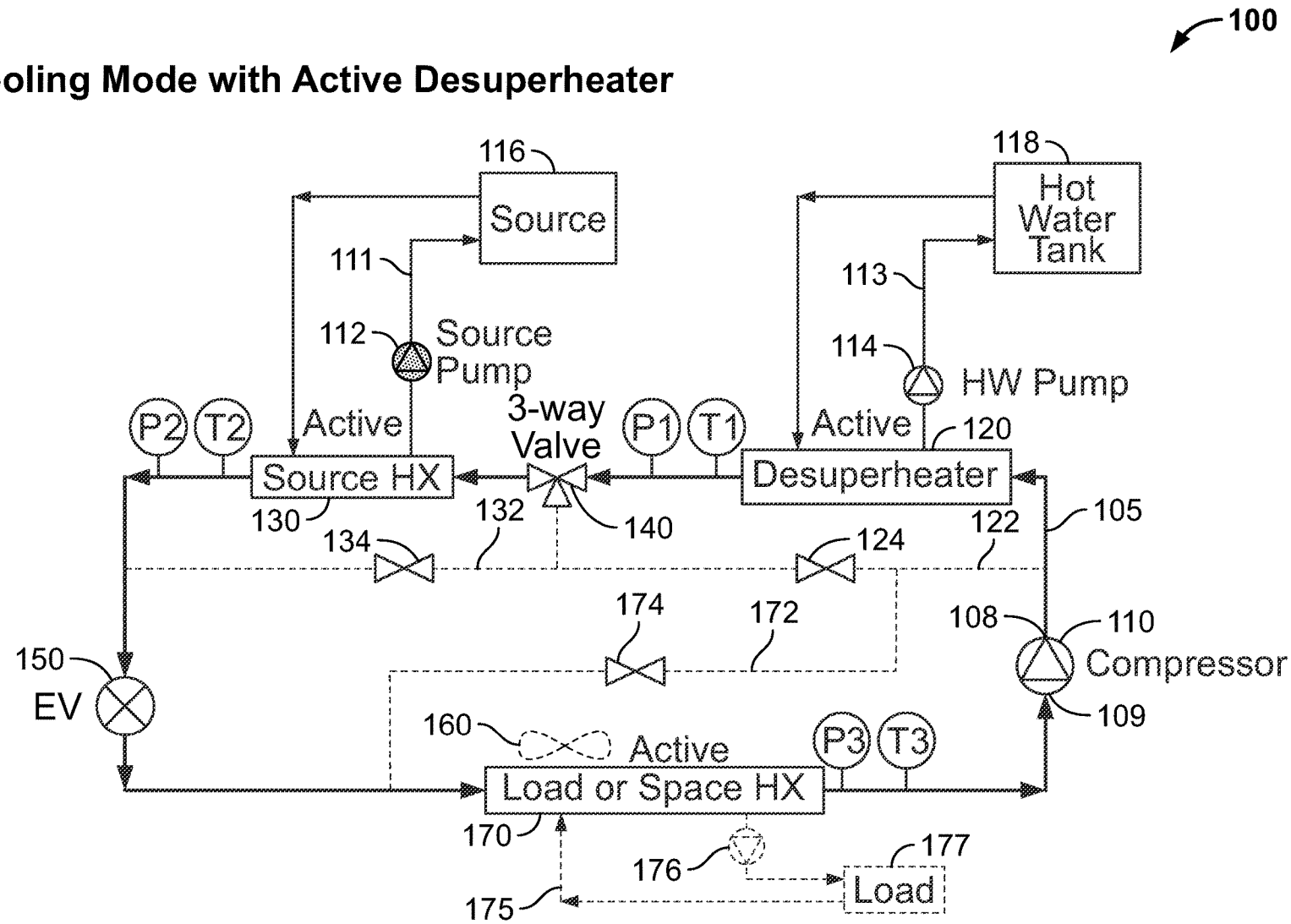
FIG. 3 is a schematic showing the HVAC system of FIG. 1 in a cooling mode with an active desuperheater.
Figure 4:
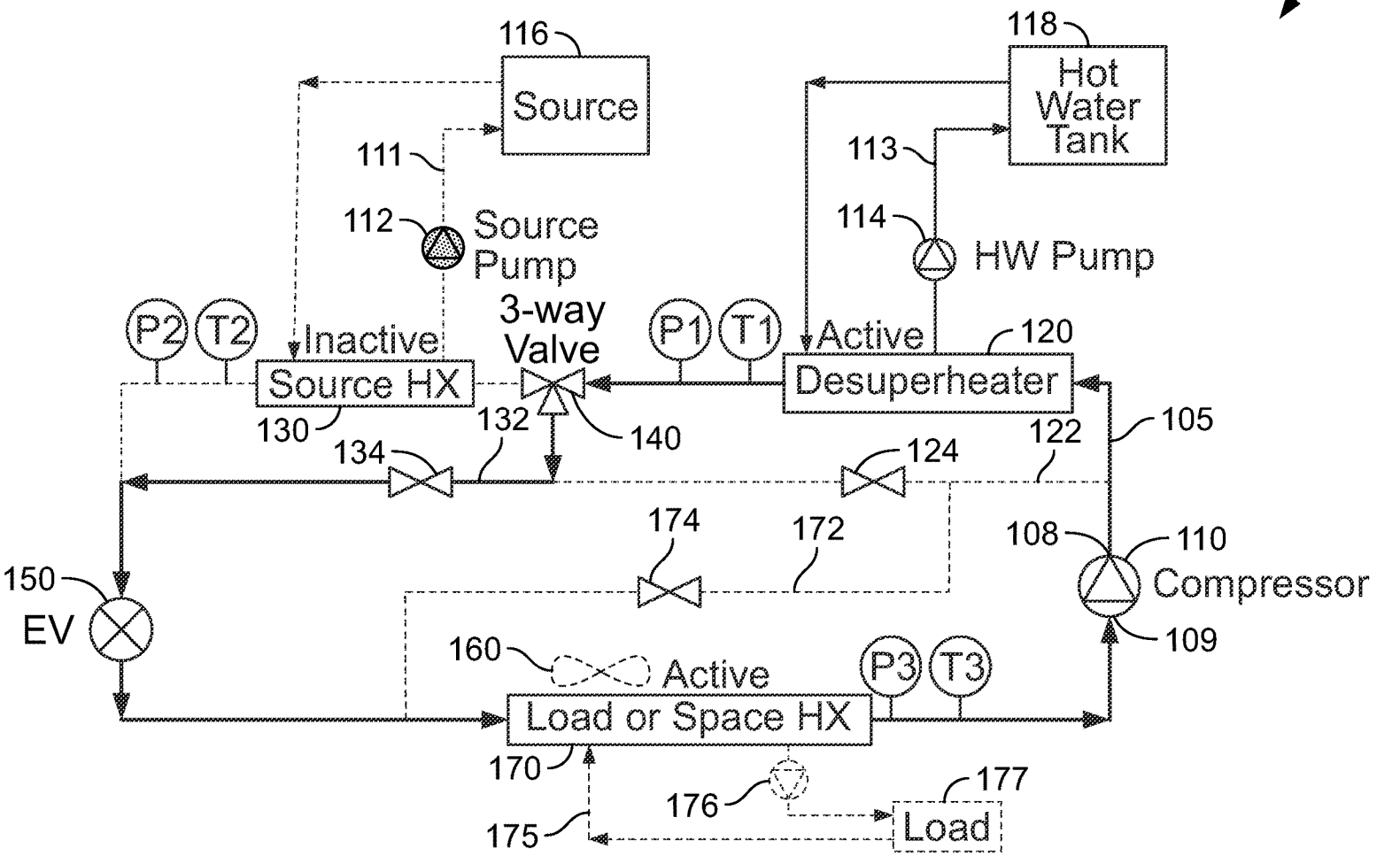
FIG. 4 is a schematic showing the HVAC system of FIG. 1 in a cooling mode with an active desuperheater and expansion valve boost.
Figure 5:
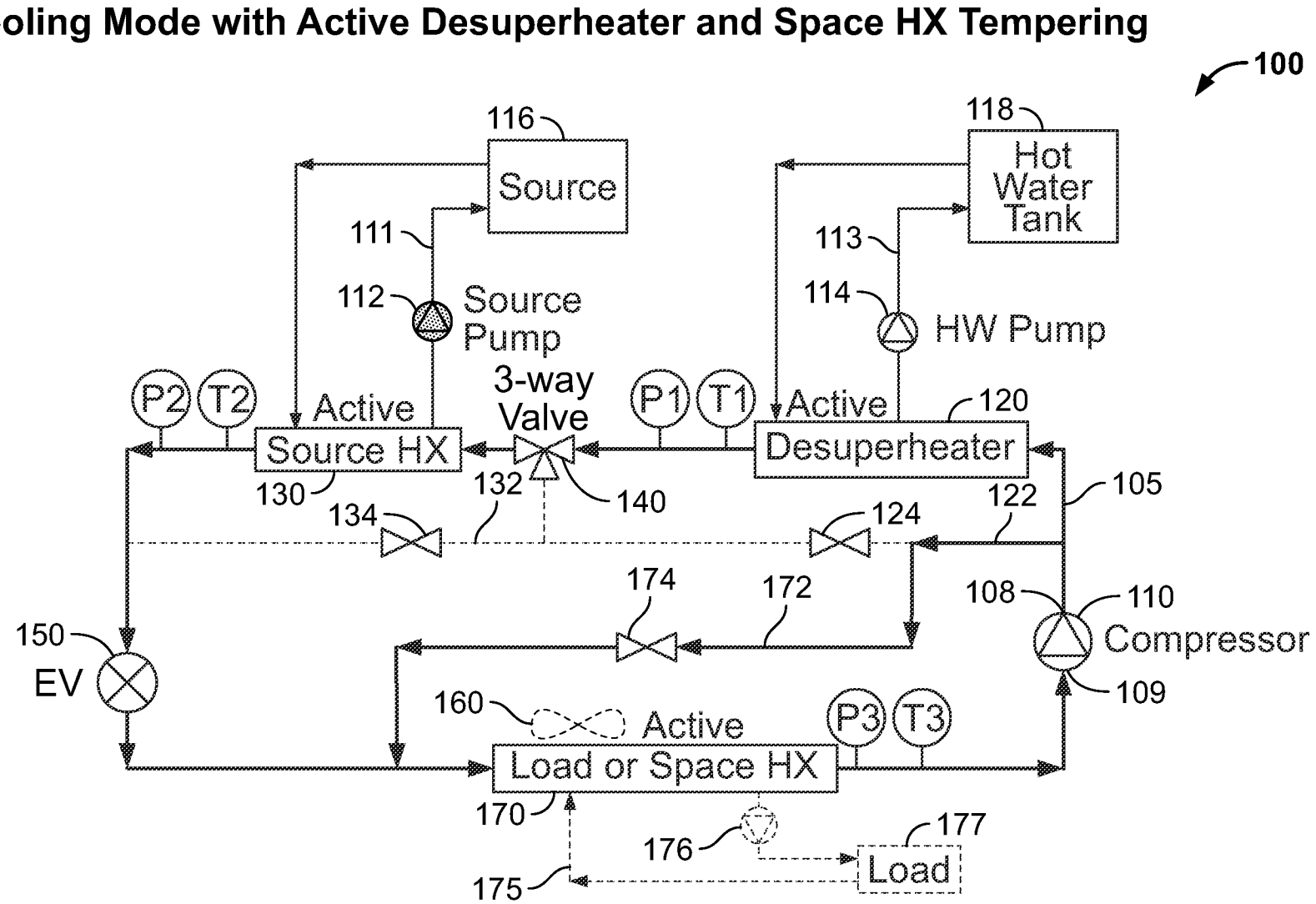
FIG. 5 is a schematic showing the HVAC system of FIG. 1 in a cooling mode with an active desuperheater and space heat exchanger tempering.
Figure 6:
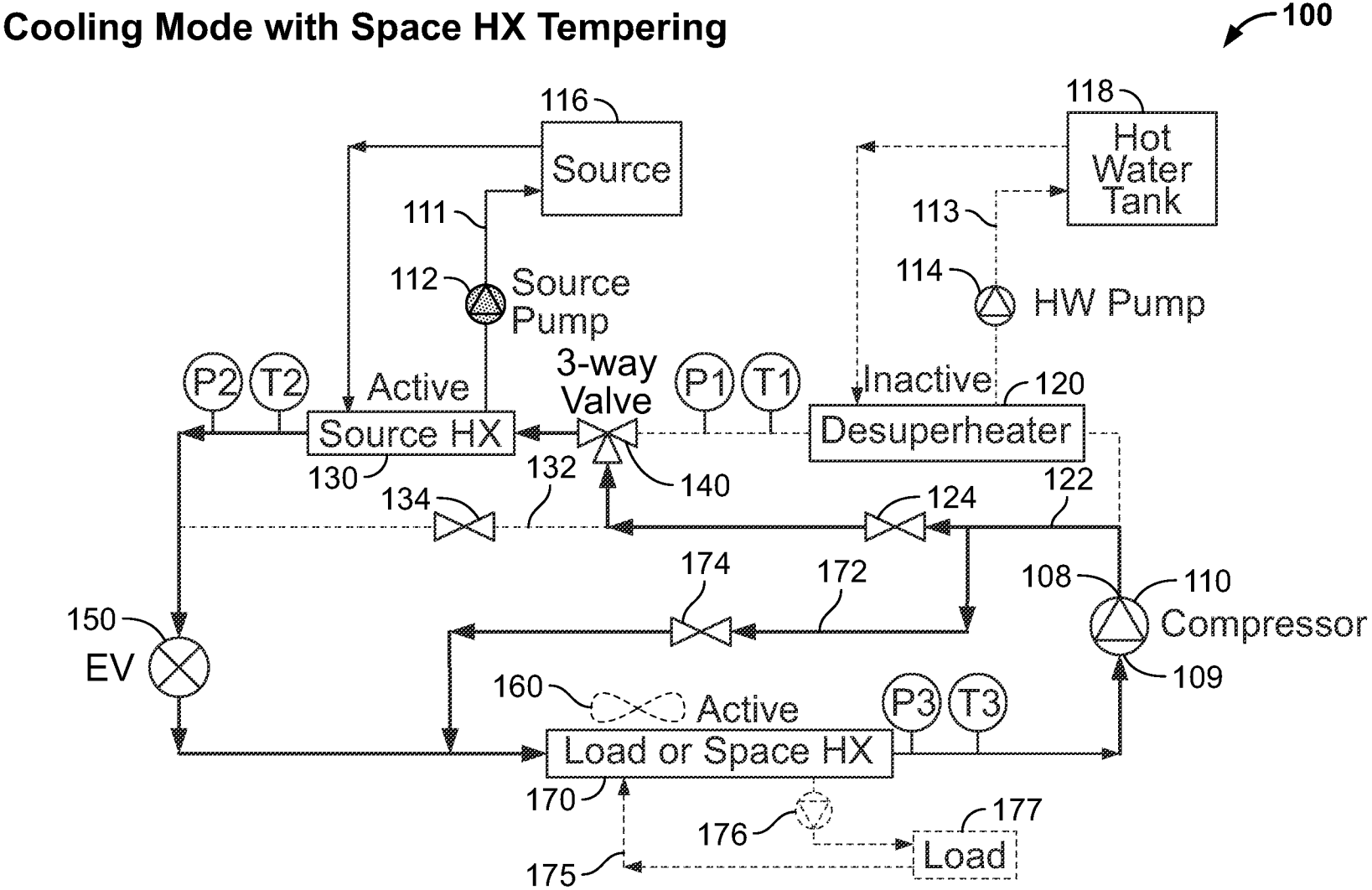
FIG. 6 is a schematic showing the HVAC system of FIG. 1 in a cooling mode with space heat exchanger tempering.

Turning now to the drawings and to FIGS. 1-6 in particular, there are shown various operating modes of HVAC system 100 configured to condition air in a space and optionally to heat water for domestic, commercial and/or industrial process purposes. FIG. 1 shows a representative schematic of hardware components for HVAC system 100. FIG. 2 shows HVAC system 100 configured to operate in a cooling mode. FIG. 3 shows HVAC system 100 configured to operate in a cooling mode with an active desuperheater. FIG. 4 shows HVAC system 100 configured to operate in a cooling mode with an active desuperheater and expansion valve boost. FIG. 5 shows HVAC system 100 configured to operate in a cooling mode with an active desuperheater and space heat exchanger tempering. FIG. 6 shows HVAC system 100 configured to operate in a cooling mode with space heat exchanger tempering.

Figure 19:
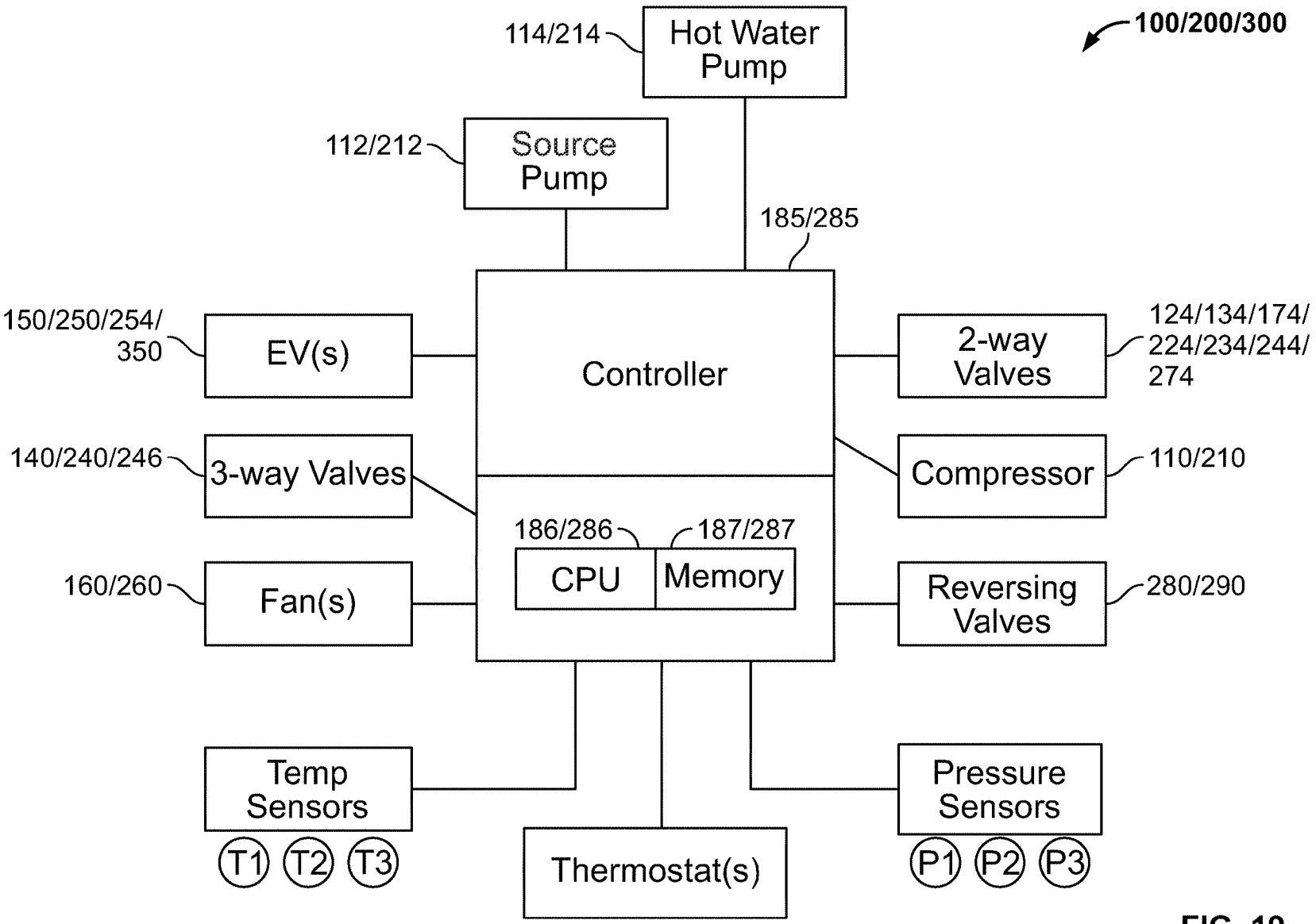
FIG. 19 is a schematic of a controller operable to control one or more aspects of any of the embodiments of the instant disclosure.

In the embodiment of FIGS. 1-6, HVAC system 100 includes refrigerant circuit 105 on which is disposed compressor 110; desuperheater heat exchanger 120; desuperheater bypass circuit 122 comprising bi-directional valve 124; source heat exchanger 130; source heat exchanger bypass circuit 132 comprising bi-directional valve 134; 3-way valve 140; expansion valve 150; load or space heat exchanger 170; bypass circuit 172 comprising bi-directional valve 174; pressure sensors P1, P2, and P3; temperature sensors T1, T2, and T3; and controller 185 (see FIG. 19). HVAC system 100 may include fan 160 for blowing air over load or space heat exchanger 170 configured as an refrigerant-to-air heat exchanger to condition air in a space. Alternatively, load or space heat exchanger 170 may be configured as a refrigerant-to-liquid heat exchanger to exchange heat with a liquid for any use, including conditioning air in a space or for industrial processes. For example, after exchanging heat with the refrigerant, the liquid may flow through fluid loop 175 by fluid pump 176 to load 177 and then back to the load or space heat exchanger 170. HVAC system 100 may be connected to source loop 111 comprising source fluid pump 112 configured to route source fluid to and from source 116. Source 116 may be any type of source, such as a fluid reservoir, a fluid cooler, or any type of heat of rejection/absorption device. HVAC system 100 may also be connected to hot water loop 113 comprising hot water pump 114 configured to pump water to and from water storage tank 118. Although not shown, it should be appreciated that HVAC system 100 may be configured to operate in corresponding heating modes by using a reversing valve, for example, to allow the direction of flow of refrigerant in the refrigerant circuit to be reversed from that shown in FIGS. 2-6. In addition, it would be appreciated that an expansion valve bypass circuit comprising a check valve may be positioned to bypass expansion valve 150, and that HVAC system 100 may include another expansion valve/expansion valve bypass circuit with check valve to control the direction of flow through these valves in a reversible refrigerant system. In this embodiment, desuperheater heat exchanger 120 and source heat exchanger 130 may be arranged in a common housing for ease of installation of HVAC system 100.

Referring to FIG. 2, HVAC system 100 is shown in a cooling mode with desuperheater heat exchanger 120 inactive. In this mode: (i) desuperheater port of 3-way valve 140 is closed to prohibit refrigerant flow through desuperheater heat exchanger 120, (ii) bi-directional valve 174 of bypass circuit 172 is closed to prohibit refrigerant flow through bypass circuit 172, (iii) bi-directional valve 124 of desuperheater bypass circuit 122 is open to allow refrigerant flow through desuperheater bypass circuit 122, (iv) bi-directional valve 134 is closed to prohibit refrigerant flow through source heat exchanger bypass circuit 132, and (v) source heat exchanger port of 3-way valve 140 is open to allow refrigerant flow through source heat exchanger 130. Compressed gaseous refrigerant exiting the compressor 110 at discharge outlet port 108 is conveyed to open bi-directional valve 124 of desuperheater bypass circuit 122 where the refrigerant is then conveyed to the desuperheater bypass port of 3-way valve 140. Three-way valve 140 then routes the refrigerant to source heat exchanger 130 acting as a condenser to exchange heat with the source fluid being conveyed through the source loop 111. The refrigerant leaving the source heat exchanger 130 is then conveyed to expansion valve 150. The refrigerant leaving expansion valve 150 is then conveyed to the load or space heat exchanger 170 acting as an evaporator, which then conveys the refrigerant to the suction inlet port 109 of the compressor 110 to continue the cycle. The capacity (e.g. speed) of source fluid pump 112 circulating the source fluid through source heat exchanger 130 may be adjusted to control heat rejected by the source heat exchanger 130 and system discharge pressure. The controller 185 may monitor temperature and pressure data reported to it from temperature sensors T2 and T3 and from pressure sensors P2 and P3 to determine subcooling and superheat, respectively, from source heat exchanger 130 and load or space heat exchanger 170.

Referring to FIG. 3, HVAC system 100 is shown configured in a cooling mode with an active desuperheater heat exchanger 120. In this mode: (i) desuperheater port of 3-way valve 140 is open to allow refrigerant flow through desuperheater heat exchanger 120, (ii) bi-directional valve 174 of bypass circuit 172 is closed to prohibit refrigerant flow through bypass circuit 172, (iii) bi-directional valve 124 of desuperheater bypass circuit 122 is closed to prohibit refrigerant flow through desuperheater bypass circuit 122, (iv) desuperheater/source heat exchanger bypass port of 3-way valve 140 is closed and bi-directional valve 134 is closed to prohibit refrigerant flow through source heat exchanger bypass circuit 132, and (v) source heat exchanger port of 3-way valve 140 is open to allow refrigerant flow through source heat exchanger 130. Compressed gaseous refrigerant exiting the compressor 110 at discharge outlet port 108 is conveyed through desuperheater heat exchanger 120 to exchange heat with the water being conveyed through the hot water loop 113, after which the refrigerant is then conveyed to 3-way valve 140. Three-way valve 140 then routes the refrigerant to source heat exchanger 130 acting as a condenser to exchange heat with the source fluid being conveyed through the source loop 111. The refrigerant leaving the source heat exchanger 130 is then conveyed to expansion valve 150. The refrigerant leaving expansion valve 150 is then conveyed to load or space heat exchanger 170 acting as an evaporator, which then conveys the refrigerant to the suction inlet port 109 of the compressor 110 to continue the cycle. In some variations of this operating mode, the controller 185 may command hot water pump 114 to turn off and therefore stop pumping water through hot water loop 113 if the temperature of the water exiting the desuperheater heat exchanger 120 is above a predetermined set point, such as 160° F. In addition to monitoring temperature and pressure data reported to it from temperature sensors T2 and T3 and from pressure sensors P2 and P3 to determine subcooling and superheat, respectively, from source heat exchanger 130 and load or space heat exchanger 170, controller 185 may also monitor temperature and pressure data reported to it from temperature sensor T1 and pressure sensor P1 to determine refrigerant conditions leaving the desuperheater heat exchanger 120.

Referring to FIG. 4, HVAC system 100 is shown configured in a cooling mode with an active desuperheater heat exchanger 120 and with expansion valve boost. In this mode: (i) desuperheater port of 3-way valve 140 is open to allow refrigerant flow through desuperheater heat exchanger 120, (ii) bi-directional valve 174 of bypass circuit 172 is closed to prohibit refrigerant flow through bypass circuit 172, (iii) bi-directional valve 124 of desuperheater bypass circuit 122 is closed to prohibit refrigerant flow through desuperheater bypass circuit 122, (iv) source heat exchanger bypass port of 3-way valve 140 is open and bi-directional valve 134 is open to allow refrigerant flow through source heat exchanger bypass circuit 132, and (v) source heat exchanger port of 3-way valve 140 is closed to prohibit refrigerant flow through source heat exchanger 130. Compressed gaseous refrigerant exiting the compressor 110 at discharge outlet port 108 is conveyed through desuperheater heat exchanger 120 to exchange heat with the water being conveyed through the hot water loop 113, after which the refrigerant is then conveyed to 3-way valve 140. Three-way valve 140 then routes the refrigerant to open bi-directional valve 134 of source heat exchanger bypass circuit 132 where the refrigerant is then conveyed to the expansion valve 150. The refrigerant leaving expansion valve 150 is then conveyed to load or space heat exchanger 170 acting as an evaporator, which then conveys the refrigerant to the suction inlet port 109 of the compressor 110 to continue the cycle.

Referring to FIG. 5, HVAC system 100 is shown configured in a cooling mode with an active desuperheater heat exchanger 120 and with load or space heat exchanger 170 tempering. In this mode: (i) desuperheater port of 3-way valve 140 is open to allow refrigerant flow through desuperheater heat exchanger 120, (ii) bi-directional valve 174 of bypass circuit 172 is open to allow refrigerant flow through bypass circuit 172, (iii) bi-directional valve 124 of desuperheater bypass circuit 122 is closed to prohibit refrigerant flow through desuperheater bypass circuit 122, (iv) desuperheater/source heat exchanger bypass port of 3-way valve 140 is closed and bi-directional valve 134 is closed to prohibit refrigerant flow through source heat exchanger bypass circuit 132, and (v) source heat exchanger port of 3-way valve 140 is open to allow refrigerant flow through source heat exchanger 130. Compressed gaseous refrigerant exiting the compressor 110 at discharge outlet port 108 is conveyed through desuperheater heat exchanger 120 to exchange heat with the water being conveyed through the hot water loop 113, after which the refrigerant is then conveyed to 3-way valve 140. Three-way valve 140 then routes the refrigerant to source heat exchanger 130 acting as a condenser to exchange heat with the source fluid being conveyed through the source loop 111. The refrigerant leaving the source heat exchanger 130 is then conveyed to expansion valve 150. The refrigerant leaving expansion valve 150 and the refrigerant conveyed by bypass circuit 172 are brought together and conveyed to load or space heat exchanger 170 acting as an evaporator, which then conveys the refrigerant to the suction inlet port 109 of the compressor 110 to continue the cycle. The controller 185 may be configured to control the opening of, and therefore the amount and/or rate of refrigerant passing through, bi-directional valve 174 to control the amount of refrigerant from bypass circuit 172 being mixed with the refrigerant exiting expansion valve 150 to control heat exchange occurring in load or space heat exchanger 170.

Referring to FIG. 6, HVAC system 100 is shown configured in a cooling mode with load or space heat exchanger 170 tempering and an inactive desuperheater heat exchanger 120. In this mode: (i) desuperheater port of 3-way valve 140 is closed to prohibit refrigerant flow through desuperheater heat exchanger 120, (ii) bi-directional valve 174 of bypass circuit 172 is open to allow refrigerant flow through bypass circuit 172, (iii) bi-directional valve 124 of desuperheater bypass circuit 122 is open to allow refrigerant flow through desuperheater bypass circuit 122, (iv) bi-directional valve 134 is closed to prohibit refrigerant flow through source heat exchanger bypass circuit 132, and (v) source heat exchanger port of 3-way valve 140 is open to allow refrigerant flow through source heat exchanger 130. Compressed gaseous refrigerant exiting the compressor 110 at discharge outlet port 108 is conveyed to open bi-directional valve 124 of desuperheater bypass circuit 122 where the refrigerant is then conveyed to the desuperheater bypass port of 3-way valve 140. Three-way valve 140 then routes the refrigerant to source heat exchanger 130 acting as a condenser to exchange heat with the source fluid being conveyed through the source loop 111. The refrigerant leaving the source heat exchanger 130 is then conveyed to expansion valve 150. In this mode, compressed gaseous refrigerant exiting the compressor 110 at discharge outlet port 108 is also conveyed to open bi-directional valve 174 of bypass circuit 172. The refrigerant leaving expansion valve 150 and the refrigerant conveyed by bypass circuit 172 are brought together and conveyed to load or space heat exchanger 170 acting as an evaporator, which then conveys the refrigerant to the suction inlet port 109 of the compressor 110 to continue the cycle. The controller 185 may be configured to control the opening of, and therefore the amount and/or rate of refrigerant passing through, one or both of bi-directional valves 124, 174 to control the amount of heat exchange occurring in source heat exchanger 130 and load or space heat exchanger 170.

With respect to any of the foregoing operating modes shown in FIGS. 2-6, the controller 185 may monitor temperature and pressure data reported to it from temperature sensors T1, T2 and T3 and from pressure sensors P1, P2 and P3, as applicable according to the respective operating mode, to determine if the refrigerant is expanding, condensing or in a steady state. With this information, the controller 185 may adjust, as needed, the opening of the 3-way valve 140, the opening of any of the bi-directional valves 124, 174,134, the opening of the expansion valve 150, the configuration of any reversing valves, the speed of the compressor 110, the speed of the source fluid pump 112, the speed of the hot water pump 114, and the speed of the fan 160 to adjust the refrigerant mass flow and quality and to optimize the efficiency of the refrigeration cycle. In addition, a fewer or greater number of temperature and pressure sensors may be utilized and positioned at different locations than what is shown in the figures. For example, temperature and/or pressure sensors may be positioned at both the inlet and the discharge locations of any heat exchanger in the system. In addition, temperature sensors and flow sensors may be positioned along one or both of the source loop 111 and the hot water loop 113.

Figure 7:
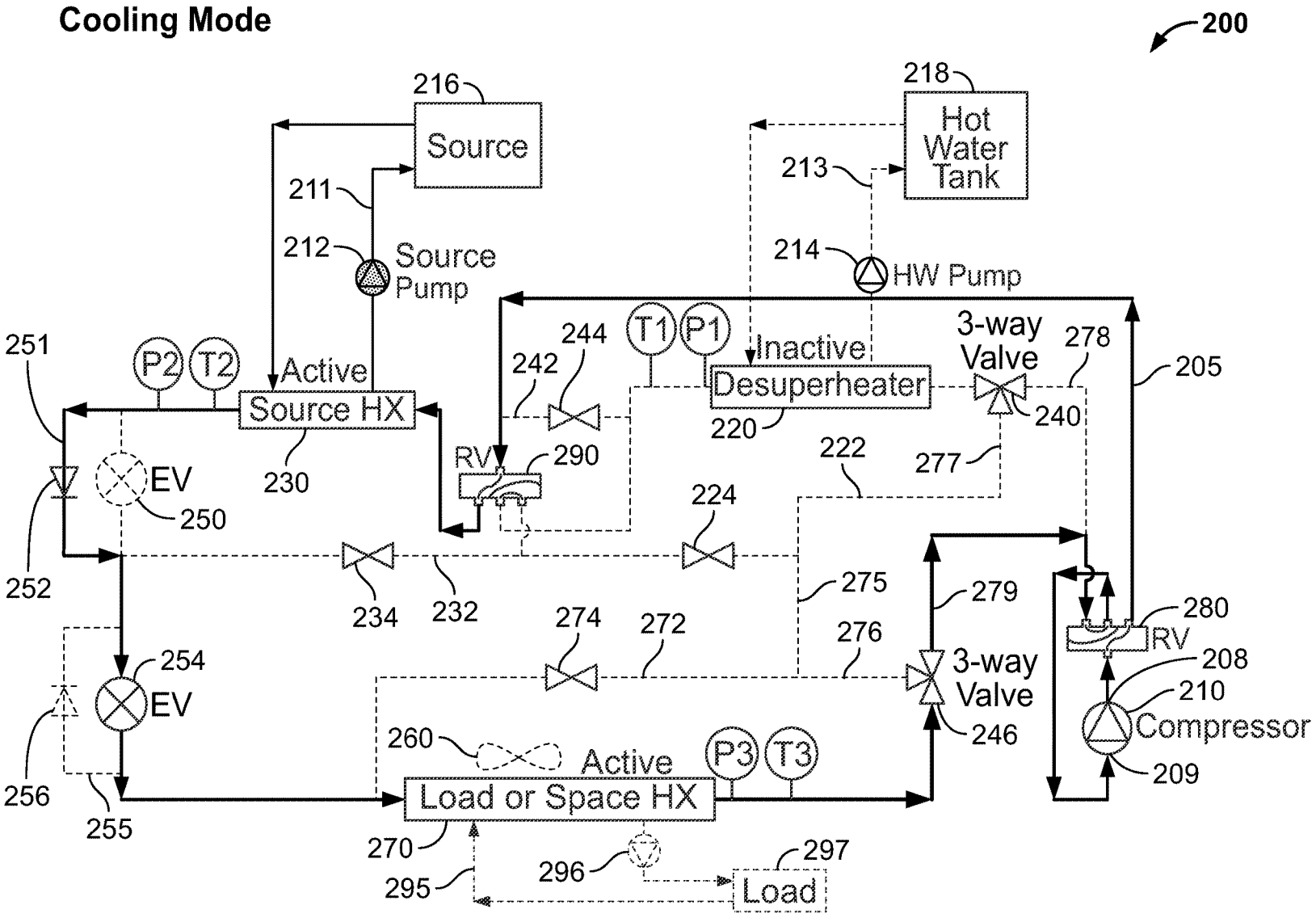
FIG. 7 is a schematic showing another embodiment of an HVAC system of the instant disclosure in a cooling mode.
Figure 8:
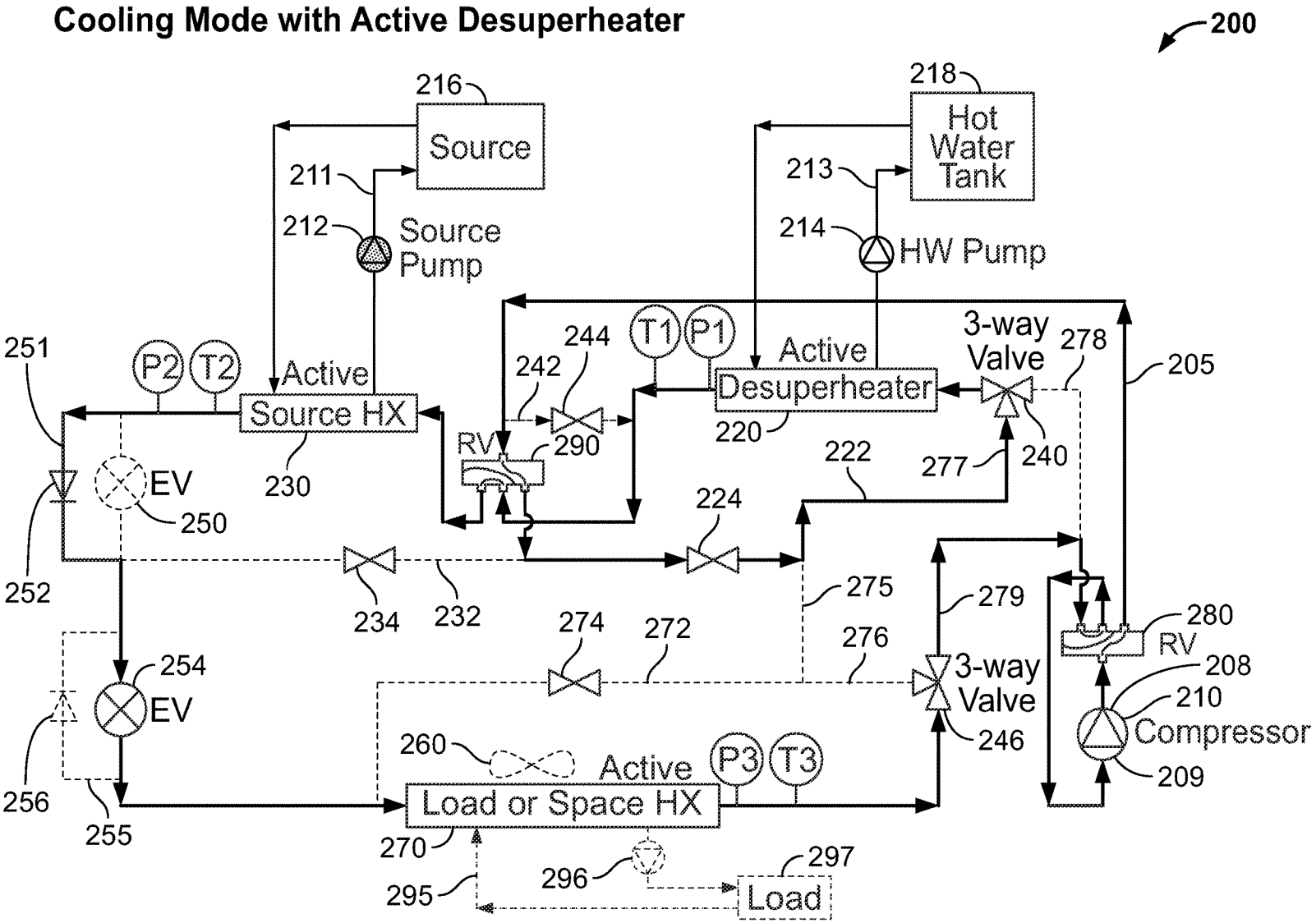
FIG. 8 is a schematic showing the HVAC system of FIG. 7 in a cooling mode with an active desuperheater.
Figure 9:
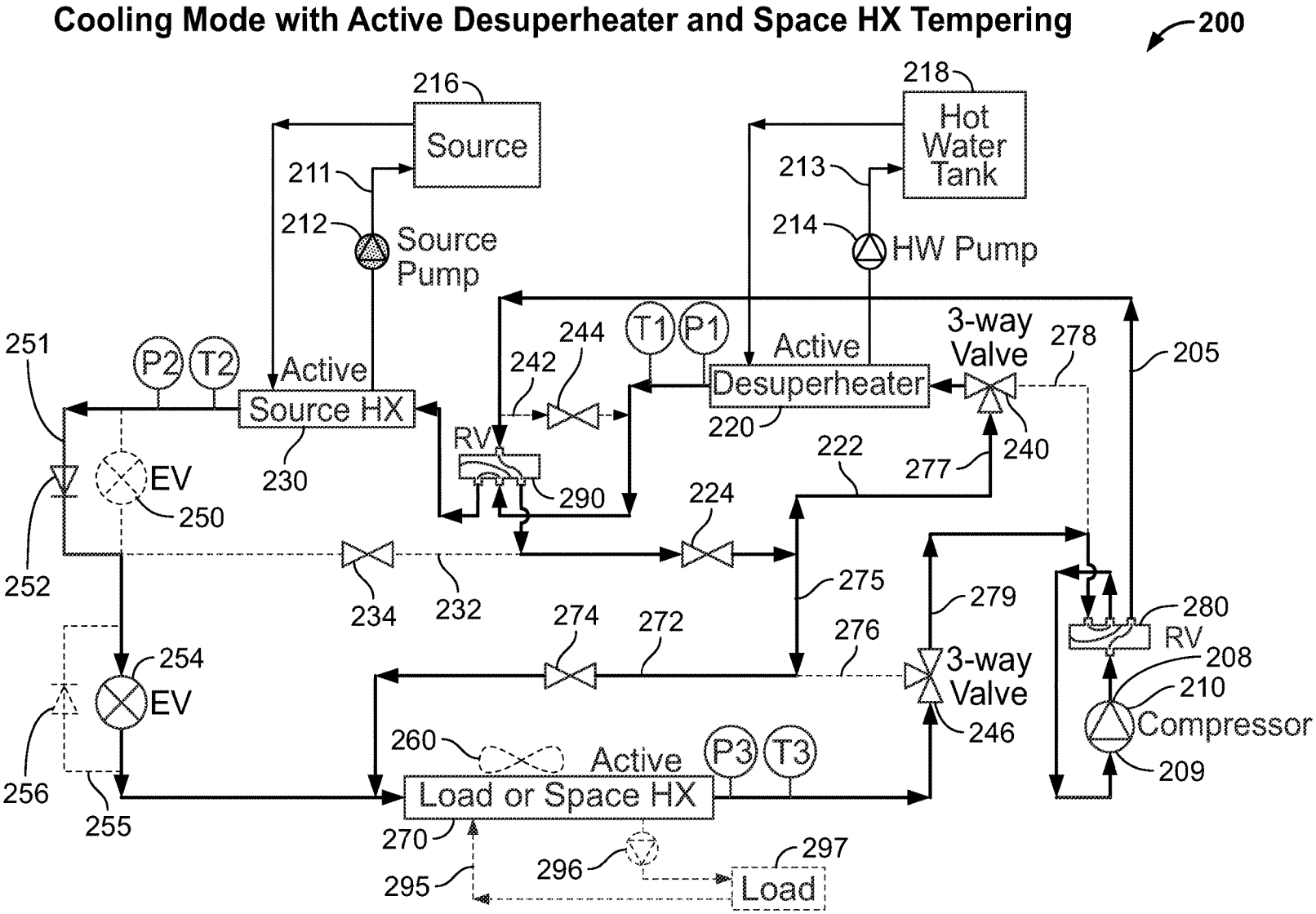
FIG. 9 is a schematic showing the HVAC system of FIG. 7 in a cooling mode with an active desuperheater and space heat exchanger tempering.
Figure 10:
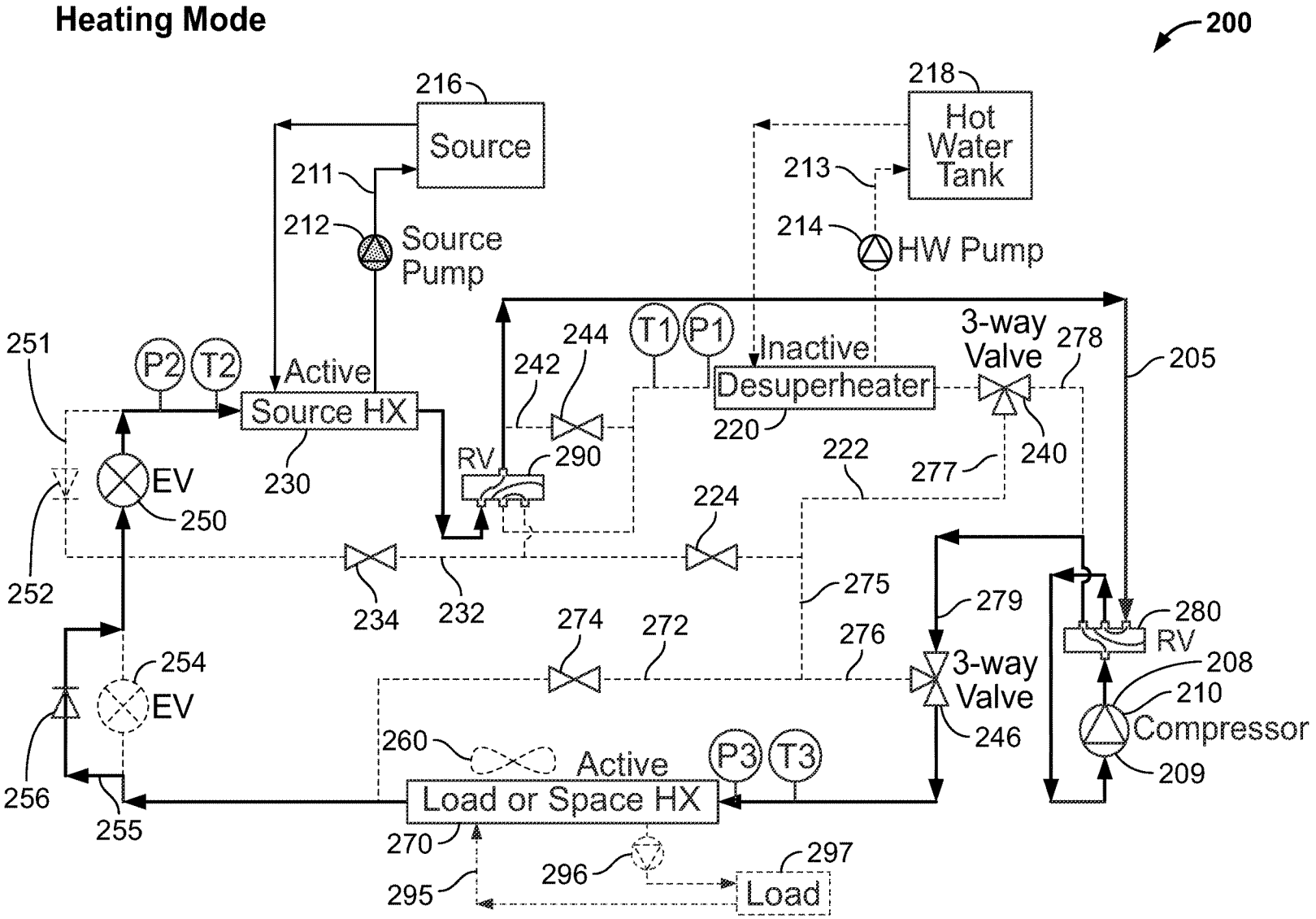
FIG. 10 is a schematic showing the HVAC system of FIG. 7 in a heating mode.
Figure 11:
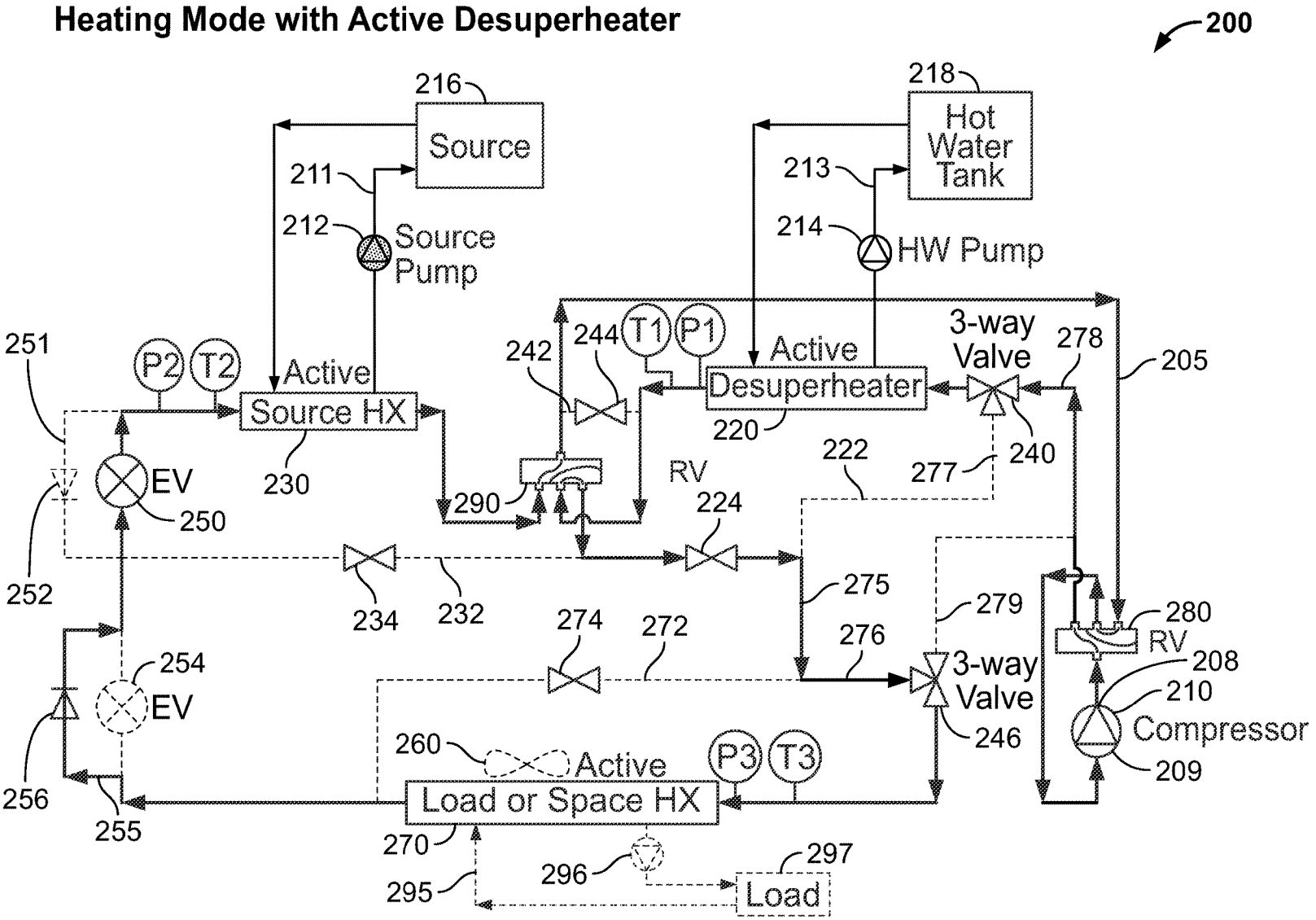
FIG. 11 is a schematic showing the HVAC system of FIG. 7 in a heating mode with an active desuperheater.
Figure 12:
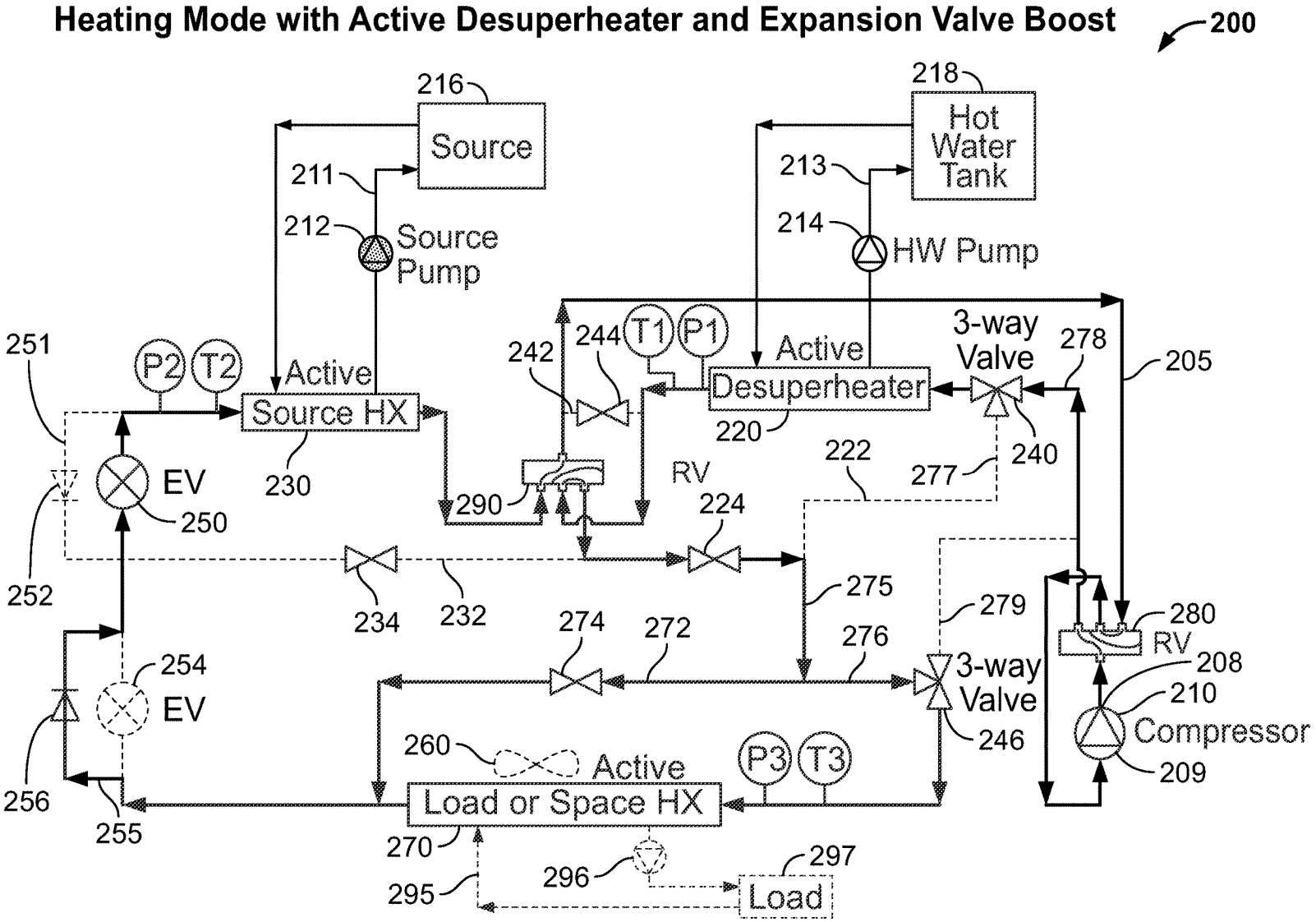
FIG. 12 is a schematic showing the HVAC system of FIG. 7 in a heating mode with an active desuperheater and expansion valve boost.

Turning now to FIGS. 7-12, there are shown various operating modes of HVAC system 200 configured to condition air in a space and optionally to heat water for domestic, commercial, or industrial process uses. FIG. 7 shows HVAC system 200 configured to operate in a cooling mode. FIG. 8 shows HVAC system 200 configured to operate in a cooling mode with an active desuperheater. FIG. 9 shows HVAC system 200 configured to operate in a cooling mode with an active desuperheater and space heat exchanger tempering. FIG. 10 shows HVAC system 200 configured to operate in a heating mode. FIG. 11 shows HVAC system 200 configured to operate in a heating mode with an active desuperheater. FIG. 12 shows HVAC system 200 configured to operate in a heating mode with an active desuperheater and expansion valve boost.

In the embodiment of FIGS. 7-12, HVAC system 200 includes refrigerant circuit 205 on which is disposed compressor 210; reversing valves 280,290; desuperheater heat exchanger 220; desuperheater loop 222 comprising bi-directional valve 224; source heat exchanger 230; 3-way valves 240,246; expansion valves 250,254; expansion valve bypass circuits 251,255 comprising check valves 252,256; load or space heat exchanger 270; bypass circuit 272 comprising bi-directional valve 274; bypass circuits 232,242 comprising bi-directional valves 234,244; pressure sensors P1, P2, and P3; temperature sensors T1, T2, and T3; and controller 285 (see FIG. 19). HVAC system 200 may include fan 260 (not shown) for blowing air over load or space heat exchanger 270 configured as an refrigerant-to-air heat exchanger to condition air in a space. Alternatively, load or space heat exchanger 270 may be configured as a refrigerant-to-liquid heat exchanger to exchange heat with a liquid for any use, including conditioning air in a space or for industrial processes. For example, after exchanging heat with the refrigerant, the liquid may flow through fluid loop 295 by fluid pump 296 to load 297 and then back to the load or space heat exchanger 270. HVAC system 200 may be connected to source loop 211 comprising source fluid pump 212 configured to route source fluid to and from source 216. Source 216 may be any type of source, such as a fluid reservoir, a fluid cooler, or any type of heat of rejection/absorption device. HVAC system 200 may also be connected to hot water loop 213 comprising hot water pump 214 configured to pump water to and from water storage tank 218. In this embodiment, desuperheater heat exchanger 220 and source heat exchanger 230 may be arranged in a common housing for ease of installation of HVAC system 200.

Referring to FIG. 7, HVAC system 200 is shown in a cooling mode with desuperheater heat exchanger 220 inactive. In this mode: (i) all ports of 3-way valve 240 are closed to prohibit refrigerant flow through desuperheater heat exchanger 220 and to urge refrigerant leaving 3-way valve 246 to flow to reversing valve 280, (ii) bi-directional valve 274 of bypass circuit 272 is closed to prohibit refrigerant flow through bypass circuit 272, (iii) bi-directional valve 224 of desuperheater loop 222 is closed to prohibit refrigerant flow through desuperheater loop 222, (iv) bi-directional valves 234,244 are closed to prohibit refrigerant flow through bypass circuits 232,242 and (v) the port of 3-way valve 246 that is connected to conduit 276 is closed to prohibit refrigerant flow to bypass circuit 272 and to desuperheater loop 222. Compressed gaseous refrigerant exiting the compressor 210 at discharge outlet port 208 is conveyed to reversing valve 280, which directs the refrigerant to reversing valve 290, where the refrigerant is then conveyed to the source heat exchanger 230 acting as a condenser to exchange heat with the source fluid being conveyed through the source loop 211. The refrigerant leaving the source heat exchanger 230 is then conveyed to expansion valve bypass circuit 251, through check valve 252, and then to expansion valve 254. The refrigerant leaving expansion valve 254 is then conveyed to load or space heat exchanger 270 acting as an evaporator, which then conveys the refrigerant to the 3-way valve 246, which routes the refrigerant to reversing valve 280, which routes the refrigerant to the suction inlet port 209 of the compressor 210 to continue the cycle. As discussed above for FIGS. 1-6, the capacity (e.g. speed) of source fluid pump 212 circulating the source fluid through source heat exchanger 230 may be adjusted to control heat rejected by the source heat exchanger 230 and system discharge pressure. The controller 285 may monitor temperature and pressure data reported to it from temperature sensors T2 and T3 and from pressure sensors P2 and P3 to determine subcooling and superheat, respectively, from source heat exchanger 230 and load or space heat exchanger 270.

Referring to FIG. 8, HVAC system 200 is shown in a cooling mode with an active desuperheater heat exchanger 220. In this mode: (i) two desuperheater ports of 3-way valve 240 are open to allow refrigerant flow through desuperheater heat exchanger 220 while the port of 3-way valve 240 connected to conduit 278 is closed to prohibit refrigerant flow to reversing valve 280 and to urge refrigerant leaving 3-way valve 246 to be directed to reversing valve 280, (ii) bi-directional valve 274 of bypass circuit 272 is closed to prohibit refrigerant flow through bypass circuit 272, (iii) bi-directional valve 224 of desuperheater loop 222 is open to allow refrigerant flow through desuperheater heat exchanger 220, (iv) bi-directional valves 234,244 are closed to prohibit refrigerant flow through bypass circuits 232,242, and (v) acting in concert with the closed bi-directional valve 274, the port of 3-way valve 246 that is connected to conduit 276 is closed to prohibit refrigerant flow through bypass circuit 272 and to 3-way valve 246. Compressed gaseous refrigerant exiting the compressor 210 at discharge outlet port 208 of refrigerant circuit 205 is conveyed to reversing valve 280, which directs the refrigerant to reversing valve 290, which conveys the refrigerant to open bi-directional valve 224, which conveys the refrigerant to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, then to the source heat exchanger 230 acting as a condenser to exchange heat with the source fluid being conveyed through the source loop 211. The refrigerant leaving the source heat exchanger 230 is conveyed to expansion valve bypass circuit 251, through check valve 252, and then to expansion valve 254. The refrigerant leaving expansion valve 254 is then conveyed to load or space heat exchanger 270 acting as an evaporator, which then conveys the refrigerant to the 3-way valve 246, which routes the refrigerant to reversing valve 280, which routes the refrigerant to the suction inlet port 209 of the compressor 210 to continue the cycle. In some variations of this operating mode, the controller 285 may command hot water pump 214 to turn off and therefore stop pumping water through hot water loop 213 if the temperature of the water exiting the desuperheater heat exchanger 220 is above a predetermined set point, such as 160° F. In addition to monitoring temperature and pressure data reported to it from temperature sensors T2 and T3 and from pressure sensors P2 and P3 to determine subcooling and superheat, respectively, from source heat exchanger 230 and load or space heat exchanger 270, controller 285 may also monitor temperature and pressure data reported to it from temperature sensor T1 and pressure sensor P1 to determine refrigerant conditions leaving the desuperheater heat exchanger 220.

Referring to FIG. 9, HVAC system 200 is shown in a cooling mode with an active desuperheater heat exchanger 220 and load or space heat exchanger 270 tempering. In this mode: (i) two desuperheater ports of 3-way valve 240 are open to allow refrigerant flow through desuperheater heat exchanger 220 while the port of 3-way valve 240 connected to conduit 278 is closed to prohibit refrigerant flow to reversing valve 280 and to urge refrigerant leaving 3-way valve 246 to be directed to reversing valve 280, (ii) bi-directional valve 274 of bypass circuit 272 is open to allow refrigerant flow through bypass circuit 272, (iii) bi-directional valve 224 of desuperheater loop 222 is open to allow refrigerant flow through desuperheater heat exchanger 220 and through bypass circuit 272, (iv) bi-directional valves 234,244 are closed to prohibit refrigerant flow through bypass circuits 232,242, and (v) the port of 3-way valve 246 that is connected to conduit 276 is closed to urge refrigerant to flow through bypass circuit 272 and not to 3-way valve 246. Compressed gaseous refrigerant exiting the compressor 210 at discharge outlet port 208 of refrigerant circuit 205 is conveyed to reversing valve 280, which directs the refrigerant to reversing valve 290, which conveys the refrigerant to open bi-directional valve 224, which conveys a first portion of the refrigerant to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, then to the source heat exchanger 230 acting as a condenser to exchange heat with the source fluid being conveyed through the source loop 211. The refrigerant leaving the source heat exchanger 230 is conveyed to expansion valve bypass circuit 251, through check valve 252, and then to expansion valve 254. In addition, a second portion of the refrigerant leaving bi-directional valve 224 is conveyed to bypass circuit 272 through open bi-directional valve 274 and is brought together with the first portion of the refrigerant leaving the expansion valve 254 and conveyed to load or space heat exchanger 270 acting as an evaporator. Refrigerant leaving load or space heat exchanger 270 is conveyed to 3-way valve 246, which routes the refrigerant to reversing valve 280, which routes the refrigerant to the suction inlet port 209 of the compressor 210 to continue the cycle. The controller 285 may be configured to control the opening of, and therefore the amount and/or rate of refrigerant passing through, bi-directional valve 274 and/or 3-way valve 240 to control the amount of the refrigerant being conveyed through bypass circuit 272 that is mixed with the refrigerant exiting expansion valve 254 to control heat exchange occurring in load or space heat exchanger 270. In some variations of this operating mode, the controller 285 may command hot water pump 214 to turn off and therefore stop pumping water through hot water loop 213 if the temperature of the water exiting the desuperheater heat exchanger 220 is above a predetermined set point, such as 160° F. In addition to monitoring temperature and pressure data reported to it from temperature sensors T2 and T3 and from pressure sensors P2 and P3 to determine subcooling and superheat, respectively, from source heat exchanger 230 and load or space heat exchanger 270, controller 285 may also monitor temperature and pressure data reported to it from temperature sensor T1 and pressure sensor P1 to determine refrigerant conditions leaving the desuperheater heat exchanger 220.

Referring to FIG. 10, HVAC system 200 is shown in a heating mode with desuperheater heat exchanger 220 inactive. In this mode: (i) all ports of 3-way valve 240 are closed to prohibit refrigerant flow through desuperheater heat exchanger 220 and to urge compressed gaseous refrigerant leaving reversing valve 280 to flow to 3-way valve 246, (ii) bi-directional valve 274 of bypass circuit 272 is closed to prohibit refrigerant flow through bypass circuit 272, (iii) bi-directional valve 224 of desuperheater loop 222 is closed to prohibit refrigerant flow to reversing valve 290, (iv) bi-directional valves 234,244 are closed to prohibit refrigerant flow through bypass circuits 232,242 and (v) the port of 3-way valve 246 that is connected to conduit 276 is closed to prohibit refrigerant flow from 3-way valve 246 to bypass circuit 272 and to desuperheater loop 222. Compressed gaseous refrigerant exiting the compressor 210 at discharge outlet port 208 of refrigerant circuit 205 is conveyed to 3-way valve 246, which conveys the refrigerant to load or space heat exchanger 270 acting as a condenser. Refrigerant leaving the load or space heat exchanger 270 is convey to expansion valve bypass circuit 255, through check valve 256, and then to expansion valve 250. The refrigerant leaving expansion valve 250 is then conveyed to source heat exchanger 230 acting as an evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle. As discussed above for FIGS. 1-6 and 7, the capacity (e.g. speed) of source fluid pump 212 circulating the source fluid through source heat exchanger 230 may be adjusted to control heat rejected by the source heat exchanger 230 and system discharge pressure.

Referring to FIG. 11, HVAC system 200 is shown in a heating mode with an active desuperheater heat exchanger 220. In this mode: (i) two desuperheater ports of 3-way valve 240 are open to allow refrigerant flow through desuperheater heat exchanger 220 while the port of 3-way valve 240 connected to conduit 277 is closed to prohibit refrigerant flow to conduit 277 and to urge refrigerant leaving bi-directional valve 224 to be directed to conduits 275,276, which convey the refrigerant to 3-way valve 246, (ii) bi-directional valve 274 of bypass circuit 272 is closed to prohibit refrigerant flow through bypass circuit 272, (iii) bi-directional valve 224 is open to allow refrigerant to flow to conduits 275,276, which convey the refrigerant to 3-way valve 246, (iv) bi-directional valves 234,244 are closed to prohibit refrigerant flow through bypass circuits 232,242, and (v) the port of 3-way valve 246 that is connected to conduit 276 is open to allow refrigerant to be conveyed by conduits 275,276 to 3-way valve 246 while the port of 3-way valve 246 that is connected to conduit 279 is closed to prohibit refrigerant from flowing to or from reversing valve 280. Compressed gaseous refrigerant exiting the compressor 210 at discharge outlet port 208 of refrigerant circuit 205 is conveyed to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, which routes the refrigerant through open bi-directional valve 224. The refrigerant is then conveyed by conduits 275,276 to 3-way valve 246, which conveys the refrigerant to load or space heat exchanger 270 acting as a condenser. Refrigerant leaving the load or space heat exchanger 270 is conveyed to expansion valve bypass circuit 255, through check valve 256, and then to expansion valve 250. The refrigerant leaving expansion valve 250 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle. In some variations of this operating mode, the controller 285 may command hot water pump 214 to turn off and therefore stop pumping water through hot water loop 213 if the temperature of the water exiting the desuperheater heat exchanger 220 is above a predetermined set point, such as 160° F. In addition to monitoring temperature and pressure data reported to it from temperature sensors T2 and T3 and from pressure sensors P2 and P3, controller 285 may also monitor temperature and pressure data reported to it from temperature sensor T1 and pressure sensor P1 to determine refrigerant conditions leaving the desuperheater heat exchanger 220.

Referring to FIG. 12, HVAC system 200 is shown in a heating mode with an active desuperheater heat exchanger 220 and expansion valve boost for ensuring that expansion valve 254 will control the system properly and to avoid flashing of refrigerant prior to entry into the source heat exchanger 230. In this mode: (i) two desuperheater ports of 3-way valve 240 are open to allow refrigerant flow through desuperheater heat exchanger 220 while the port of 3-way valve 240 connected to conduit 277 is closed to prohibit refrigerant flow to conduit 277 and to urge refrigerant leaving bi-directional valve 224 to be directed to conduit 275, (ii) bi-directional valve 274 of bypass circuit 272 is open to cause a portion of the refrigerant to bypass the load or space heat exchanger 270 to provide boost to expansion valve 250, (iii) bi-directional valve 224 is open to allow refrigerant to flow to conduit 275 and then to bi-directional valve 274 and to 3-way valve 246, (iv) bi-directional valves 234,244 are closed to prohibit refrigerant flow through bypass circuits 232,242, and (v) the port of 3-way valve 246 that is connected to conduit 276 is open to allow refrigerant to be conveyed by conduits 275,276 to 3-way valve 246 while the port of 3-way valve 246 that is connected to conduit 279 is closed to prohibit refrigerant from flowing to or from reversing valve 280. Compressed gaseous refrigerant exiting the compressor 210 at discharge outlet port 208 of refrigerant circuit 205 is conveyed to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, which routes the refrigerant through open bi-directional valve 224. The controller 285 may be configured to control the opening of, and therefore the amount and/or rate of refrigerant passing through, bi-directional valve 274 and/or 3-way valve 246 to control the amount of the refrigerant being conveyed through bypass circuit 272 that is mixed with the refrigerant exiting load or space heat exchanger 270 to provide a boost to the inlet conditions of the refrigerant entering expansion valve 254. Consequently, upon leaving the bi-directional valve 224, a first portion of the refrigerant is conveyed to the 3-way valve 246 and a second portion of the refrigerant is conveyed to open bi-directional valve 274 where the amount of the first and second portions is determined by the orifice sizes commanded by controller 285 in the respective 3-way valve 246 and bi-directional valve 274. The first portion of the refrigerant leaving the 3-way valve is conveyed to load or space heat exchanger 270 acting as a condenser while the second portion of the refrigerant leaving bi-directional valve 274 of bypass circuit 272 bypasses the load or space heat exchanger 270 and is mixed with the first portion of the refrigerant leaving the load or space heat exchanger 270. All of the refrigerant is then conveyed to expansion valve bypass circuit 255, through check valve 256, and then to expansion valve 250. The refrigerant leaving expansion valve 250 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle. In some variations of this operating mode, the controller 285 may command hot water pump 214 to turn off and therefore stop pumping water through hot water loop 213 if the temperature of the water exiting the desuperheater heat exchanger 220 is above a predetermined set point, such as 160° F. In addition to monitoring temperature and pressure data reported to it from temperature sensors T2 and T3 and from pressure sensors P2 and P3, controller 285 may also monitor temperature and pressure data reported to it from temperature sensor T1 and pressure sensor P1 to determine refrigerant conditions leaving the desuperheater heat exchanger 220.

Figure 13:
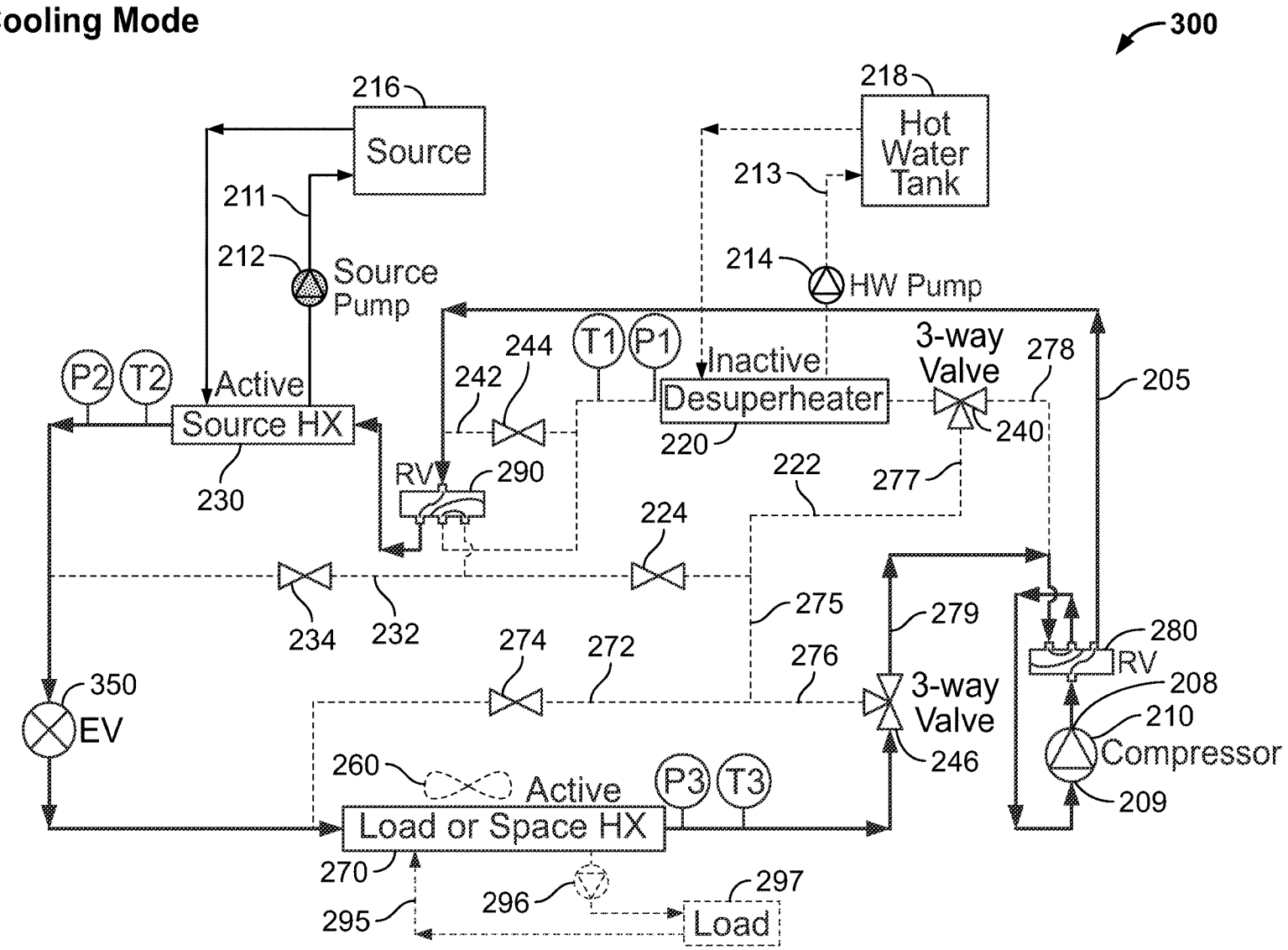
FIG. 13 is a schematic showing another embodiment of an HVAC system of the instant disclosure in a cooling mode.
Figure 14:
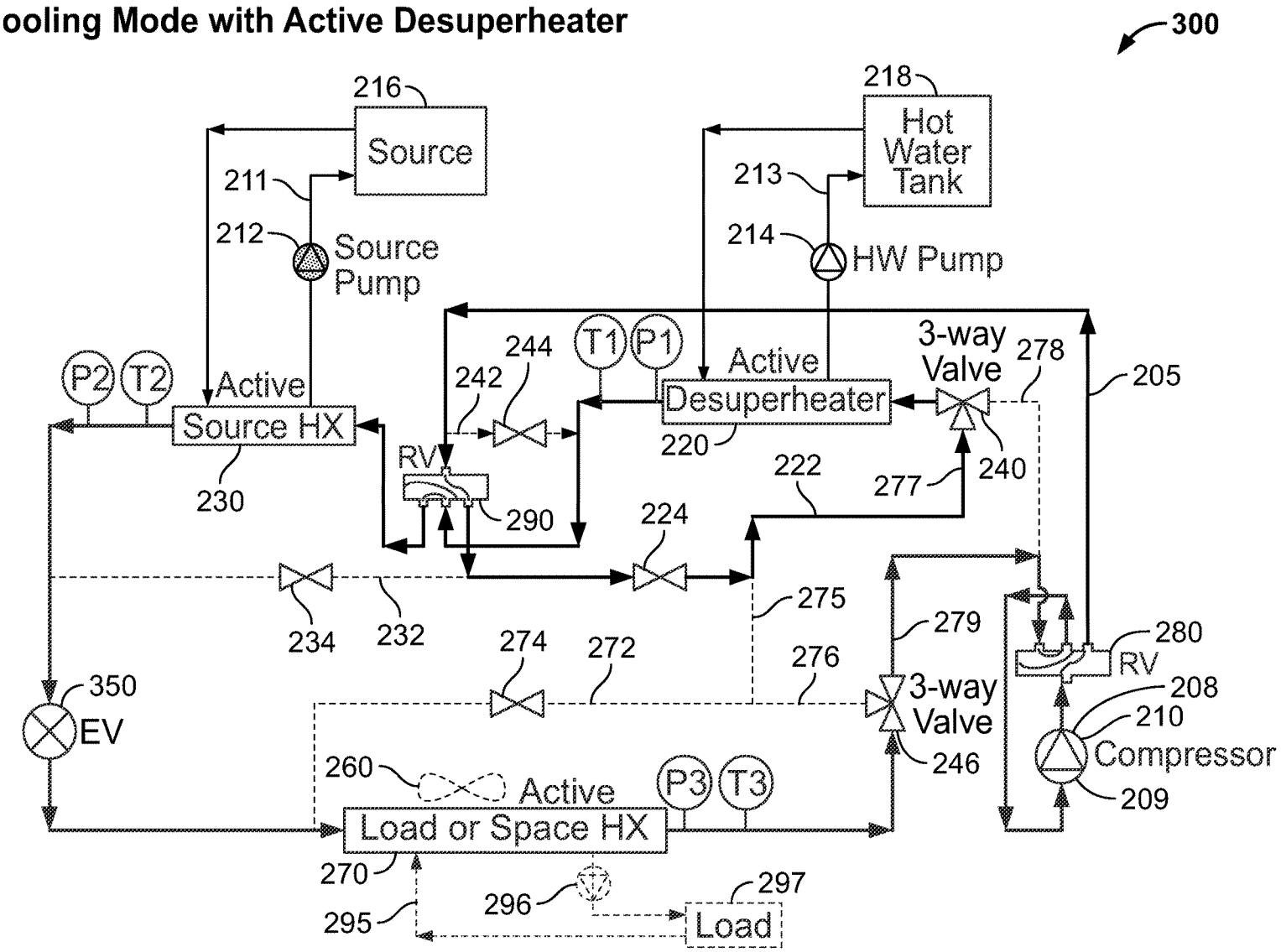
FIG. 14 is a schematic showing the HVAC system of FIG. 13 in a cooling mode with an active desuperheater.
Figure 15:
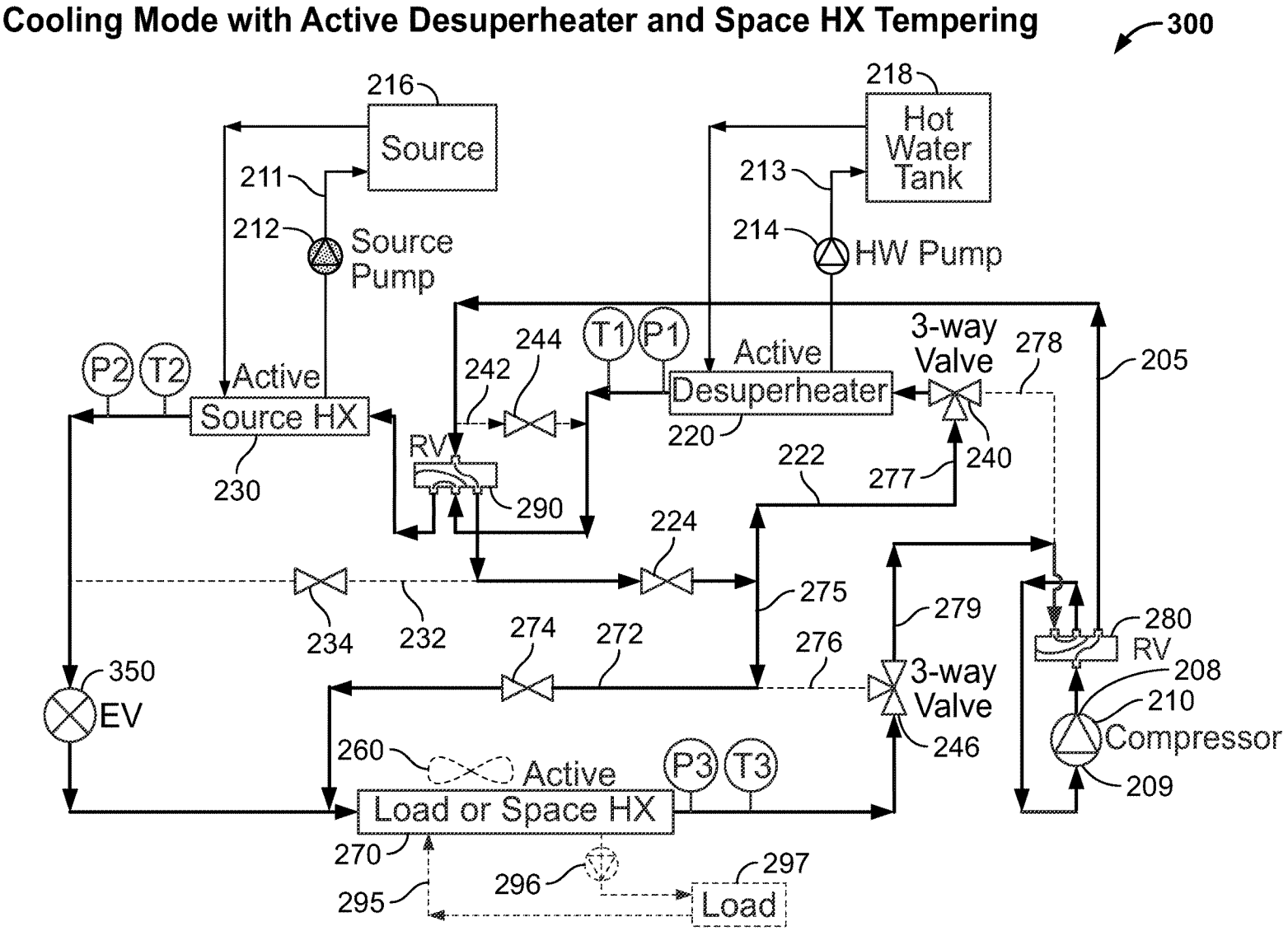
FIG. 15 is a schematic showing the HVAC system of FIG. 13 in a cooling mode with an active desuperheater and space heat exchanger tempering.
Figure 16:
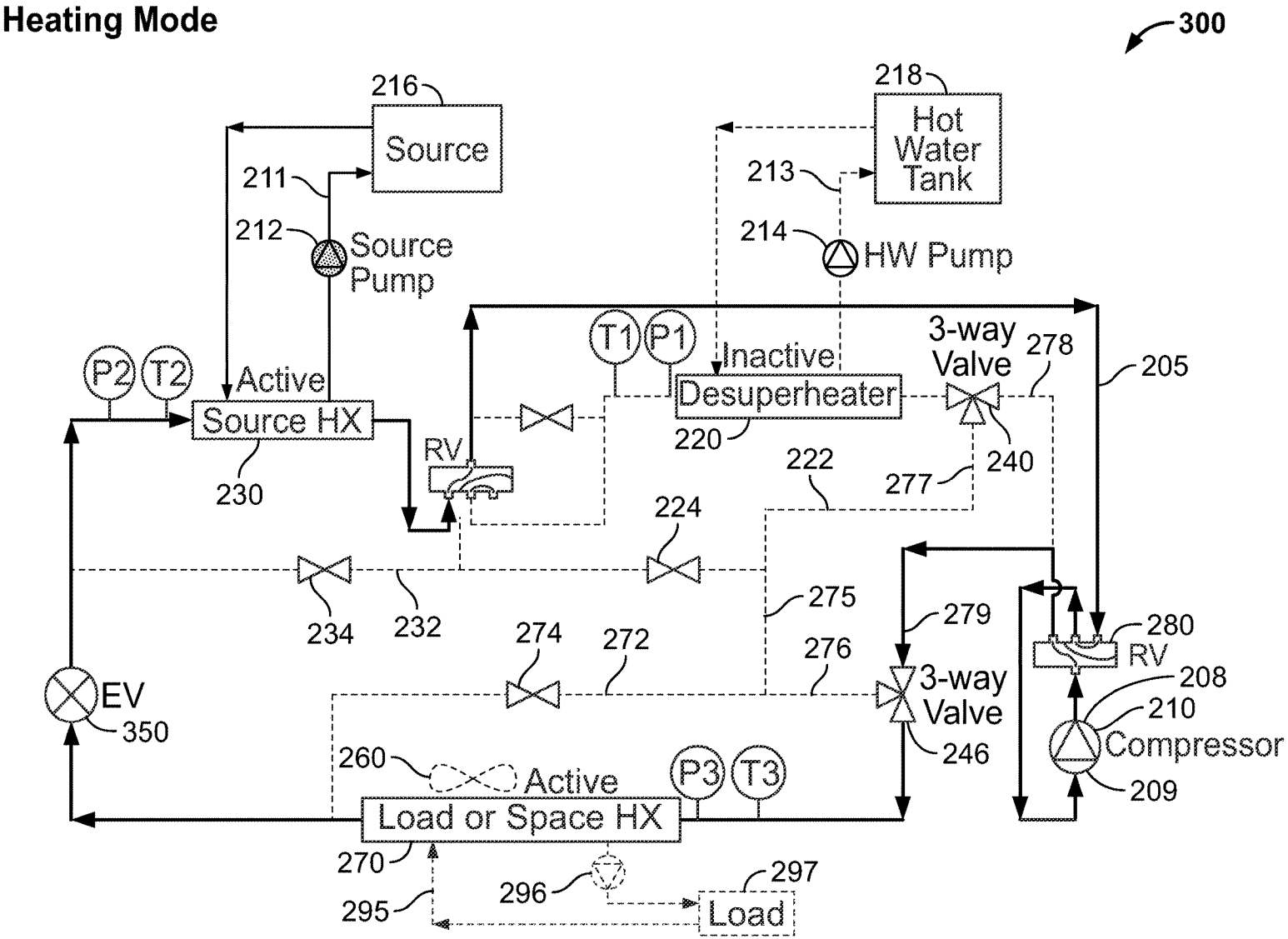
FIG. 16 is a schematic showing the HVAC system of FIG. 13 in a heating mode.
Figure 17:
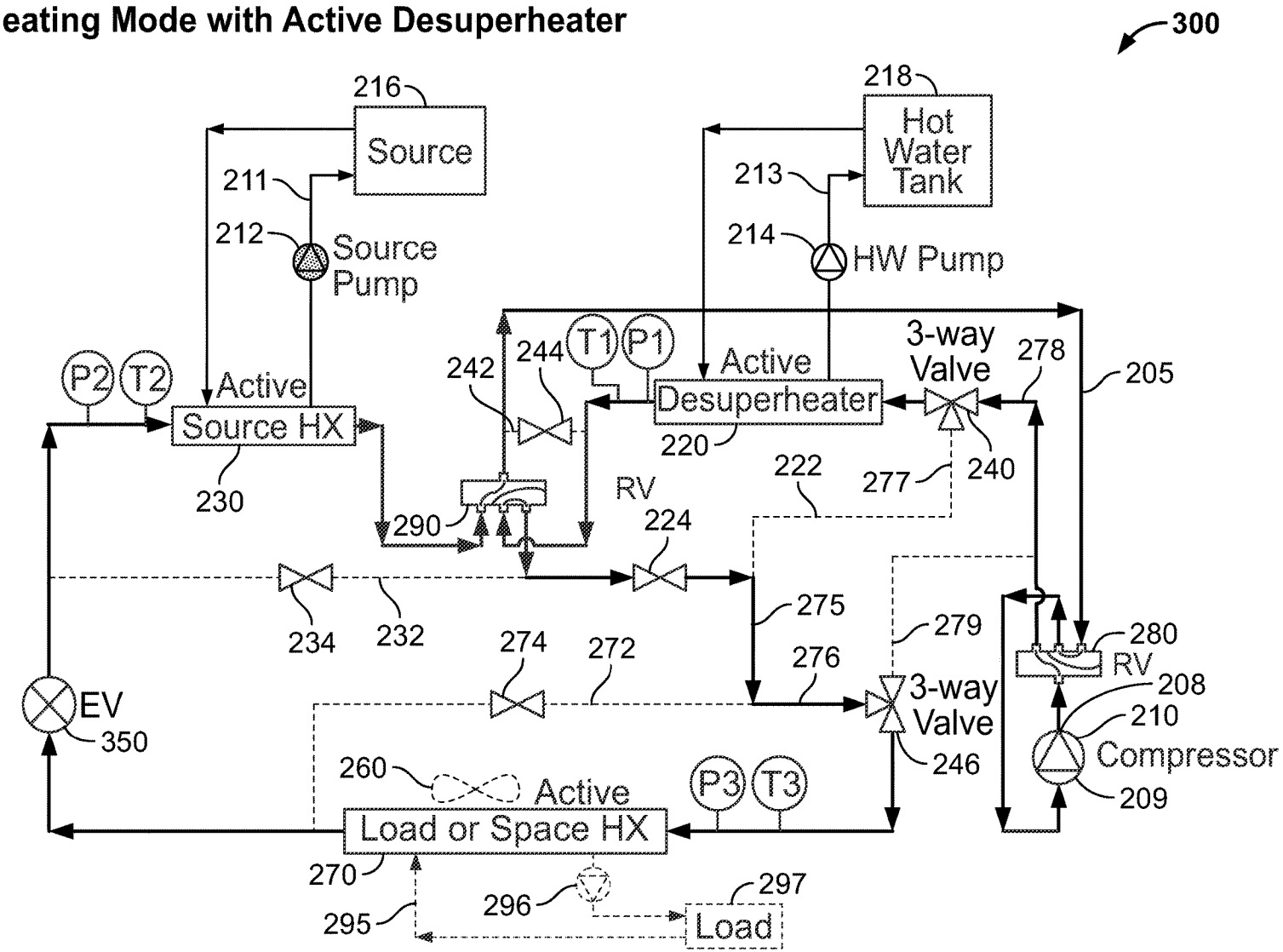
FIG. 17 is a schematic showing the HVAC system of FIG. 13 in a heating mode with an active desuperheater.
Figure 18:
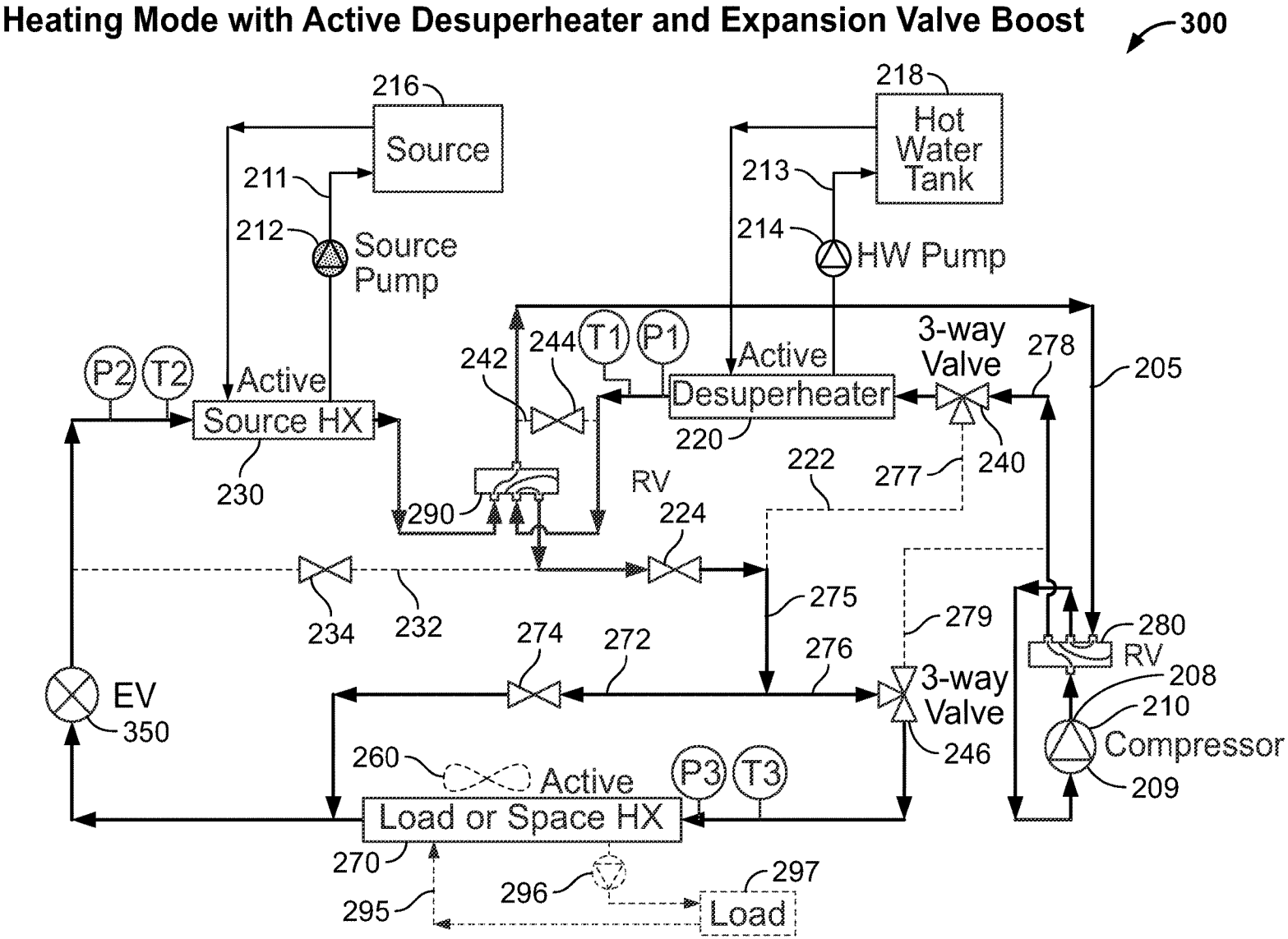
FIG. 18 is a schematic showing the HVAC system of FIG. 13 in a heating mode with an active desuperheater and expansion valve boost.

Turning now to FIGS. 13-18, there are shown various operating modes of HVAC system 300 configured to condition air in a space and optionally to heat water for domestic, commercial, or industrial process uses. FIG. 13 shows HVAC system 300 configured to operate in a cooling mode. FIG. 14 shows HVAC system 300 configured to operate in a cooling mode with an active desuperheater. FIG. 15 shows HVAC system 300 configured to operate in a cooling mode with an active desuperheater and space heat exchanger tempering. FIG. 16 shows HVAC system 300 configured to operate in a heating mode. FIG. 17 shows HVAC system 300 configured to operate in a heating mode with an active desuperheater. FIG. 18 shows HVAC system 300 configured to operate in a heating mode with an active desuperheater and expansion valve boost.

In the embodiment of FIGS. 13-18, HVAC system 300 includes all of the same components, arrangement, features, and functionality as shown in the embodiment of FIGS. 7-12 except that the pair of expansion valves 250,254, expansion valve bypass circuits 251,255, and check valves 252,256 have been replaced with a single, bi-directional, mechanical or electronic expansion valve 350 positioned between source heat exchanger 230 and load or space heat exchanger 270.

Referring to FIG. 13, HVAC system 300 is shown in a cooling mode with desuperheater heat exchanger 220 inactive. In this mode: (i) all ports of 3-way valve 240 are closed to prohibit refrigerant flow through desuperheater heat exchanger 220 and to urge refrigerant leaving 3-way valve 246 to flow to reversing valve 280, (ii) bi-directional valve 274 of bypass circuit 272 is closed to prohibit refrigerant flow through bypass circuit 272, (iii) bi-directional valve 224 of desuperheater loop 222 is closed to prohibit refrigerant flow through desuperheater loop 222, (iv) bi-directional valves 234,244 are closed to prohibit refrigerant flow through bypass circuits 232,242 and (v) the port of 3-way valve 246 that is connected to conduit 276 is closed to prohibit refrigerant flow to bypass circuit 272 and to desuperheater loop 222. Compressed gaseous refrigerant exiting the compressor 210 at discharge outlet port 208 is conveyed to reversing valve 280, which directs the refrigerant to reversing valve 290, where the refrigerant is then conveyed to the source heat exchanger 230 acting as a condenser to exchange heat with the source fluid being conveyed through the source loop 211. The refrigerant leaving the source heat exchanger 230 is then conveyed to expansion valve 350. The refrigerant leaving expansion valve 350 is then conveyed to load or space heat exchanger 270 acting as an evaporator, which then conveys the refrigerant to the 3-way valve 246, which routes the refrigerant to reversing valve 280, which routes the refrigerant to the suction inlet port 209 of the compressor 210 to continue the cycle.

Referring to FIG. 14, HVAC system 300 is shown in a cooling mode with an active desuperheater heat exchanger 220. In this mode: (i) two desuperheater ports of 3-way valve 240 are open to allow refrigerant flow through desuperheater heat exchanger 220 while the port of 3-way valve 240 connected to conduit 278 is closed to prohibit refrigerant flow to reversing valve 280 and to urge refrigerant leaving 3-way valve 246 to be directed to reversing valve 280, (ii) bi-directional valve 274 of bypass circuit 272 is closed to prohibit refrigerant flow through bypass circuit 272, (iii) bi-directional valve 224 of desuperheater loop 222 is open to allow refrigerant flow through desuperheater heat exchanger 220, (iv) bi-directional valves 234,244 are closed to prohibit refrigerant flow through bypass circuits 232,242, and (v) acting in concert with the closed bi-directional valve 274, the port of 3-way valve 246 that is connected to conduit 276 is closed to prohibit refrigerant flow through bypass circuit 272 and to 3-way valve 246. Compressed gaseous refrigerant exiting the compressor 210 at discharge outlet port 208 of refrigerant circuit 205 is conveyed to reversing valve 280, which directs the refrigerant to reversing valve 290, which conveys the refrigerant to open bi-directional valve 224, which conveys the refrigerant to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, then to the source heat exchanger 230 acting as a condenser to exchange heat with the source fluid being conveyed through the source loop 211. The refrigerant leaving the source heat exchanger 230 is conveyed to expansion valve 350. The refrigerant leaving expansion valve 350 is then conveyed to load or space heat exchanger 270 acting as an evaporator, which then conveys the refrigerant to the 3-way valve 246, which routes the refrigerant to reversing valve 280, which routes the refrigerant to the suction inlet port 209 of the compressor 210 to continue the cycle.

Referring to FIG. 15, HVAC system 300 is shown in a cooling mode with an active desuperheater heat exchanger 220 and load or space heat exchanger 270 tempering. In this mode: (i) two desuperheater ports of 3-way valve 240 are open to allow refrigerant flow through desuperheater heat exchanger 220 while the port of 3-way valve 240 connected to conduit 278 is closed to prohibit refrigerant flow to reversing valve 280 and to urge refrigerant leaving 3-way valve 246 to be directed to reversing valve 280, (ii) bi-directional valve 274 of bypass circuit 272 is open to allow refrigerant flow through bypass circuit 272, (iii) bi-directional valve 224 of desuperheater loop 222 is open to allow refrigerant flow through desuperheater heat exchanger 220 and through bypass circuit 272, (iv) bi-directional valves 234,244 are closed to prohibit refrigerant flow through bypass circuits 232,242, and (v) the port of 3-way valve 246 that is connected to conduit 276 is closed to urge refrigerant to flow through bypass circuit 272 and not to 3-way valve 246. Compressed gaseous refrigerant exiting the compressor 210 at discharge outlet port 208 of refrigerant circuit 205 is conveyed to reversing valve 280, which directs the refrigerant to reversing valve 290, which conveys the refrigerant to open bi-directional valve 224, which conveys a first portion of the refrigerant to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, then to the source heat exchanger 230 acting as a condenser to exchange heat with the source fluid being conveyed through the source loop 211. The refrigerant leaving the source heat exchanger 230 is conveyed to expansion valve 350. In addition, a second portion of the refrigerant leaving bi-directional valve 224 is conveyed to bypass circuit 272 through open bi-directional valve 274 and is brought together with the first portion of the refrigerant leaving the expansion valve 350 and conveyed to load or space heat exchanger 270 acting as an evaporator. Refrigerant leaving load or space heat exchanger 270 is conveyed to 3-way valve 246, which routes the refrigerant to reversing valve 280, which routes the refrigerant to the suction inlet port 209 of the compressor 210 to continue the cycle. The controller 285 may be configured to control the opening of, and therefore the amount and/or rate of refrigerant passing through, bi-directional valve 274 and/or 3-way valve 240 to control the amount of the refrigerant being conveyed through bypass circuit 272 that is mixed with the refrigerant exiting expansion valve 350 to control heat exchange occurring in load or space heat exchanger 270.

Referring to FIG. 16, HVAC system 300 is shown in a heating mode with desuperheater heat exchanger 220 inactive. In this mode: (i) all ports of 3-way valve 240 are closed to prohibit refrigerant flow through desuperheater heat exchanger 220 and to urge compressed gaseous refrigerant leaving reversing valve 280 to flow to 3-way valve 246, (ii) bi-directional valve 274 of bypass circuit 272 is closed to prohibit refrigerant flow through bypass circuit 272, (iii) bi-directional valve 224 of desuperheater loop 222 is closed to prohibit refrigerant flow to reversing valve 290, (iv) bi-directional valves 234,244 are closed to prohibit refrigerant flow through bypass circuits 232,242 and (v) the port of 3-way valve 246 that is connected to conduit 276 is closed to prohibit refrigerant flow from 3-way valve 246 to bypass circuit 272 and to desuperheater loop 222. Compressed gaseous refrigerant exiting the compressor 210 at discharge outlet port 208 of refrigerant circuit 205 is conveyed to 3-way valve 246, which conveys the refrigerant to load or space heat exchanger 270 acting as a condenser. Refrigerant leaving the load or space heat exchanger 270 is convey to expansion valve 350. The refrigerant leaving expansion valve 350 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle.

Referring to FIG. 17, HVAC system 300 is shown in a heating mode with an active desuperheater heat exchanger 220. In this mode: (i) two desuperheater ports of 3-way valve 240 are open to allow refrigerant flow through desuperheater heat exchanger 220 while the port of 3-way valve 240 connected to conduit 277 is closed to prohibit refrigerant flow to conduit 277 and to urge refrigerant leaving bi-directional valve 224 to be directed to conduits 275,276, which convey the refrigerant to 3-way valve 246, (ii) bi-directional valve 274 of bypass circuit 272 is closed to prohibit refrigerant flow through bypass circuit 272, (iii) bi-directional valve 224 is open to allow refrigerant to flow to conduits 275,276, which convey the refrigerant to 3-way valve 246, (iv) bi-directional valves 234,244 are closed to prohibit refrigerant flow through bypass circuits 232,242, and (v) the port of 3-way valve 246 that is connected to conduit 276 is open to allow refrigerant to be conveyed by conduits 275,276 to 3-way valve 246 while the port of 3-way valve 246 that is connected to conduit 279 is closed to prohibit refrigerant from flowing to or from reversing valve 280. Compressed gaseous refrigerant exiting the compressor 210 at discharge outlet port 208 of refrigerant circuit 205 is conveyed to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, which routes the refrigerant through open bi-directional valve 224. The refrigerant is then conveyed by conduits 275,276 to 3-way valve 246, which conveys the refrigerant to load or space heat exchanger 270 acting as a condenser. Refrigerant leaving the load or space heat exchanger 270 is conveyed to expansion valve 350. The refrigerant leaving expansion valve 350 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle.

Referring to FIG. 18, HVAC system 300 is shown in a heating mode with an active desuperheater heat exchanger 220 and expansion valve boost for ensuring that expansion valve 350 will control the system properly and to avoid flashing of refrigerant prior to entry into the source heat exchanger 230. In this mode: (i) two desuperheater ports of 3-way valve 240 are open to allow refrigerant flow through desuperheater heat exchanger 220 while the port of 3-way valve 240 connected to conduit 277 is closed to prohibit refrigerant flow to conduit 277 and to urge refrigerant leaving bi-directional valve 224 to be directed to conduit 275, (ii) bi-directional valve 274 of bypass circuit 272 is open to cause a portion of the refrigerant to bypass the load or space heat exchanger 270 to provide boost to expansion valve 350, (iii) bi-directional valve 224 is open to allow refrigerant to flow to conduit 275 and then to bi-directional valve 274 and to 3-way valve 246, (iv) bi-directional valves 234,244 are closed to prohibit refrigerant flow through bypass circuits 232,242, and (v) the port of 3-way valve 246 that is connected to conduit 276 is open to allow refrigerant to be conveyed by conduits 275,276 to 3-way valve 246 while the port of 3-way valve 246 that is connected to conduit 279 is closed to prohibit refrigerant from flowing to or from reversing valve 280. Compressed gaseous refrigerant exiting the compressor 210 at discharge outlet port 208 of refrigerant circuit 205 is conveyed to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, which routes the refrigerant through open bi-directional valve 224. The controller 285 may be configured to control the opening of, and therefore the amount and/or rate of refrigerant passing through, bi-directional valve 274 and/or 3-way valve 246 to control the amount of the refrigerant being conveyed through bypass circuit 272 that is mixed with the refrigerant exiting load or space heat exchanger 270 to provide a boost to the inlet conditions of the refrigerant entering expansion valve 254. Consequently, upon leaving the bi-directional valve 224, a first portion of the refrigerant is conveyed to the 3-way valve 246 and a second portion of the refrigerant is conveyed to open bi-directional valve 274 where the amount of the first and second portions is determined by the orifice sizes commanded by controller 285 in the respective 3-way valve 246 and bi-directional valve 274. The first portion of the refrigerant leaving the 3-way valve is conveyed to load or space heat exchanger 270 acting as a condenser while the second portion of the refrigerant leaving bi-directional valve 274 of bypass circuit 272 bypasses the load or space heat exchanger 270 and is mixed with the first portion of the refrigerant leaving the load or space heat exchanger 270. All of the refrigerant is then conveyed to expansion valve 350. The refrigerant leaving expansion valve 350 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle.

With respect to any of the foregoing operating modes shown in FIGS. 7-12 and 13-18, the controller 285 may monitor temperature and pressure data reported to it from temperature sensors T1, T2 and T3 and from pressure sensors P1, P2 and P3, as applicable according to the respective operating mode, to determine if the refrigerant is expanding, condensing or in a steady state. With this information, the controller 285 may adjust, as needed, the opening of any port of any of the 3-way valves 240,246, the opening of any of the bi-directional valves 224,274, 234, 244, the opening of the expansion valves 250,254, the configuration of the first and second reversing valves 280, 290, the speed of the compressor 210, the speed of the source fluid pump 212, the speed of the hot water pump 214, and the speed of the fan 260 to adjust the refrigerant mass flow and quality and to optimize the efficiency of the refrigeration cycle. In addition, a fewer or greater number of temperature and pressure sensors may be utilized and positioned at different locations than what is shown in the figures. For example, temperature and/or pressure sensors may be positioned at both the inlet and the discharge locations of any heat exchanger in the system. In addition, temperature sensors and flow sensors may be positioned along one or both of the source loop 211 and the hot water loop 213.

To switch from a cooling or heating mode with an active desuperheater shown in FIGS. 8-9, 11-12, 14-15, and 17-18 to another mode, the controller 285 of HVAC system 200, 300 is configured to throttle open and closed bi-directional valve 244. Doing so allows refrigerant to flow through bypass circuit 242 to provide adequate back pressure for reversing valve 290 to reverse the direction of refrigerant in refrigerant circuit 205 as required by the new operating mode called for by the system or a user.

In any of the operating modes shown in FIGS. 8-12 and 14-18 with an active desuperheater heat exchanger 220, when valve 234 is commanded open by controller 285, at least some refrigerant will bypass the source heat exchanger 230 and enter expansion valve 254 (FIGS. 8-9), expansion valve 250 (FIGS. 11-12), or expansion valve 350 (FIGS. 14-15 and 17-18) to control and/or eliminate partial condensation of refrigerant in the desuperheater heat exchanger 220.

Refrigerant circuits 105,205 include one or more conduits through which refrigerant flows and which fluidly connects the components of HVAC systems 100,200,300 to one another. The one or more conduits are arranged in a manner that provides highest temperature compressor discharge gas to a desuperheater when active to maximize heating efficiency by desuperheater heat exchangers 120,220 of water circulated through hot water loops 113,213. Compressors 110,210 may each be a variable capacity compressor, such as a variable speed compressor, a compressor with an integral pulse-width modulation option, or a compressor incorporating various unloading options. These types of compressors allow for better control of the operating conditions and management of the thermal load on the refrigerant circuits 105,205.

Controller 185,285 may include a processor 186,286 coupled to memory 187,287 on which one or more software algorithms are stored to process and issue commands to open, partially open, or close any of the valves disclosed herein. Open or closed feedback loops may be employed to determine current and desired valve positions.

Any of the check valves 252,256, bi-directional valves 134,124,174,224,234,244,274, 3-way valves 140,240,246, expansion valves 150,250,254,350 may be automatically cycled open and closed and/or controlled on and off with a PWM signal to modulate the amount of refrigerant flowing therethrough.

Expansion valves 150,250,254,350 may each be an electronic expansion valve, a mechanical expansion valve, a fixed-orifice/capillary tube/accurator, or any combination of the these. These valves may have bi-directional functionality or may be replaced by a pair of uni-directional expansion devices coupled with the associated bypass check valves as described above to provide refrigerant rerouting when the flow changes direction throughout the refrigerant cycle between cooling and heating modes of operation.

While specific embodiments have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

The invention claimed is:

1. An HVAC system for conditioning air in a space, comprising:

a compressor to circulate a refrigerant through a refrigerant circuit, the compressor having a discharge outlet port and an suction inlet port;

a source heat exchanger operable as either a condenser or an evaporator for exchanging heat with a source fluid;

a first load heat exchanger operable as either a condenser or an evaporator for heating or cooling air in the space;

a second load heat exchanger operable as a condenser for heating water;

a first reversing valve positioned downstream of the compressor to alternately direct the refrigerant from the discharge outlet port of the compressor to one of a second reversing valve, a first 3-way valve, and a second 3-way valve and to alternately return the refrigerant from one of the second reversing valve and the second 3-way valve to the suction inlet port of the compressor, wherein the first 3-way valve is configured to selectively direct the refrigerant to the second load heat exchanger from one of the first and second reversing valves, and the second 3-way valve is configured to selectively direct the refrigerant to the first reversing valve and the first load heat exchanger;

a bi-directional expansion valve positioned between the source and first load heat exchangers;

a first bi-directional valve positioned downstream of the second reversing valve to selectively convey the refrigerant to at least one of the first 3-way valve, the second 3-way valve, and a second bi-directional valve, wherein the second bi-directional valve modulates exchange of heat in the first load heat exchanger when the first load heat exchanger is operating as an evaporator and controls flashing of the refrigerant entering the source heat exchanger when the source heat exchanger is operating as an evaporator; and a controller comprising a processor and memory on which one or more software programs are stored, the controller configured to control operation of the compressor, the first and second reversing valves, the first and second 3-way valves, the bi-directional expansion valve, the first and second bi-directional valves, a first variable speed pump for circulating water through the second load heat exchanger, and a second variable speed pump for circulating the source fluid through the source heat exchanger.

2. The HVAC system of claim 1, wherein the compressor is a variable capacity compressor.

3. The HVAC system of claim 1, wherein the first load heat exchanger is a refrigerant-to-air heat exchanger.

4. The HVAC system of claim 1, including a fan driven by a variable speed motor, the fan configured to flow air over a portion of the first load heat exchanger.

5. The HVAC system of claim 1, wherein the bi-directional expansion valve is a fixed orifice valve, mechanical valve, or electronic valve.

6. The HVAC system of claim 1, wherein the second load heat exchanger is a refrigerant-to-liquid heat exchanger configured to exchange heat between the refrigerant in the refrigerant circuit and water in a storage loop.

7. The HVAC system of claim 6, including a storage tank for storing heated water.

8. The HVAC system of claim 1, wherein the source heat exchanger is a refrigerant-to-liquid heat exchanger configured to exchange heat between the refrigerant in the refrigerant circuit and the source fluid in a source loop.

9. The HVAC system of claim 1, including a third bi-directional valve positioned upstream of the second reversing valve to temporarily divert the refrigerant away from the second reversing valve when switching the second reversing valve from one operating configuration to another, and a fourth bi-directional valve positioned downstream of the second reversing valve and upstream of the first bi-directional valve to divert partially condensed refrigerant from the second load heat exchanger to the bi-directional expansion valve.

10. The HVAC system of claim 1, wherein in a space cooling mode, the first reversing valve diverts the refrigerant from the compressor to the second reversing valve and from the second 3-way valve to the compressor, the second reversing valve diverts the refrigerant from the first reversing valve to the source heat exchanger configured as a condenser, the first and second bi-directional valves are closed, the refrigerant leaving the bi-directional expansion valve is directed to the first load heat exchanger configured as an evaporator, and the second 3-way valve diverts the refrigerant from the first load heat exchanger to the first reversing valve.

11. The HVAC system of claim 1, wherein in a cooling mode with an active second load heat exchanger, the first reversing valve diverts the refrigerant from the compressor to the second reversing valve and from the second 3-way valve to the compressor, the second reversing valve diverts the refrigerant from the first reversing valve to the first bi-directional valve and from the second load heat exchanger to the source heat exchanger configured as a condenser, the first bi-directional valve is open, the second bi-directional valve is closed, the refrigerant leaving the bi-directional expansion valve is directed to the first load heat exchanger configured as an evaporator, and the second 3-way valve diverts the refrigerant from the first load heat exchanger to the first reversing valve.

12. The HVAC system of claim 1, wherein in a cooling mode with an active second load heat exchanger and with load heat exchanger tempering, the first reversing valve diverts the refrigerant from the compressor to the second reversing valve and from the second 3-way valve to the compressor, the second reversing valve diverts the refrigerant from the first reversing valve to the first bi-directional valve and from the second load heat exchanger to the source heat exchanger configured as a condenser, the first bi-directional valve and the second bi-directional valve are open and a first portion of the refrigerant from the first bi-directional valve is conveyed to the first 3-way valve and a second portion of the refrigerant is conveyed to the second bi-directional valve, wherein the first portion of the refrigerant is conveyed to the second load heat exchanger and then to the source heat exchanger via the second reversing valve, the first portion of the refrigerant from the bi-directional expansion valve and the second portion of the refrigerant from the second bi-directional valve are mixed and conveyed to the first load heat exchanger configured as an evaporator, and the second 3-way valve diverts the refrigerant from the first load heat exchanger to the first reversing valve.

13. The HVAC system of claim 1, wherein in a space heating mode, the first reversing valve diverts the refrigerant from the compressor to the second 3-way valve and from the second reversing valve to the compressor, the second reversing valve diverts the refrigerant from the source heat exchanger configured as an evaporator to the first reversing valve, the second 3-way valve diverts the refrigerant to the first load heat exchanger configured as a condenser, the first and second bi-directional valves are closed, the refrigerant leaving the bi-directional expansion valve is directed to the source heat exchanger configured as an evaporator, and the refrigerant leaving the source heat exchanger is directed to the second reversing valve.

14. The HVAC system of claim 1, wherein in a heating mode with an active second load heat exchanger, the first reversing valve diverts the refrigerant from the compressor to the first 3-way valve and from the second reversing valve to the compressor, the first 3-way valve diverts the refrigerant from the first reversing valve to the second load heat exchanger, and the refrigerant leaving the second load heat exchanger is conveyed to the second reversing valve, the second reversing valve diverts the refrigerant from the second load heat exchanger to the first bi-directional valve and from the source heat exchanger to the first reversing valve, the first bi-directional valve is open and the refrigerant from the first bi-directional valve is conveyed to the second 3-way valve, the second 3-way valve diverts the refrigerant to the first load heat exchanger configured as a condenser, the second bi-directional valve is closed, the refrigerant leaving the bi-directional expansion valve is directed to the source heat exchanger configured as an evaporator, and the refrigerant leaving the source heat exchanger is directed to the second reversing valve.

15. The HVAC system of claim 1, wherein in a space heating mode with an active second load heat exchanger and expansion device boost, the first reversing valve diverts the refrigerant from the compressor to the first 3-way valve and from the second reversing valve to the compressor, the first 3-way valve diverts the refrigerant from the first reversing valve to the second load heat exchanger, and the refrigerant leaving the second load heat exchanger is conveyed to the second reversing valve, the second reversing valve diverts the refrigerant from the second load heat exchanger to the first bi-directional valve and from the source heat exchanger to the first reversing valve, the first bi-directional valve and the second bi-directional valve are open and a first portion of the refrigerant from the first bi-directional valve is conveyed to the second 3-way valve and a second portion of the refrigerant is conveyed to the second bi-directional valve, the second 3-way valve diverts the first portion of the refrigerant to the first load heat exchanger configured as a condenser, wherein the second portion of the refrigerant from the second bi-directional valve is mixed with the first portion of the refrigerant from the first load heat exchanger configured as a condenser, the refrigerant leaving the bi-directional expansion valve is directed to the source heat exchanger configured as an evaporator, and the refrigerant leaving the source heat exchanger is directed to the second reversing valve.

* * * * *